US007891094B2

(12) United States Patent
Imamura et al.

(10) Patent No.: US 7,891,094 B2
(45) Date of Patent: Feb. 22, 2011

(54) METHOD OF MANUFACTURING A HOLLOW BODY USED IN AN IMAGE FORMING APPARATUS

(75) Inventors: Tsuyoshi Imamura, Sagamihara (JP); Kyohta Koetsuka, Fujisawa (JP); Yoshiyuki Takano, Hachioji (JP); Masayuki Ohsawa, Atsugi (JP); Hiroya Abe, Yokohama (JP); Mieko Terashima, Isehara (JP); Noriyuki Kamiya, Yamato (JP); Masaki Watanabe, Kawasaki (JP); Shigeharu Nakamura, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/632,439

(22) Filed: Dec. 7, 2009

(65) Prior Publication Data

US 2010/0077588 A1 Apr. 1, 2010

Related U.S. Application Data

(62) Division of application No. 11/775,455, filed on Jul. 10, 2007, now Pat. No. 7,664,441.

(30) Foreign Application Priority Data

Jul. 10, 2006 (JP) ..... 2006-188854
Jun. 28, 2007 (JP) ..... 2007-170475

(51) Int. Cl.
*B21K 1/02* (2006.01)
*G03G 19/00* (2006.01)

(52) U.S. Cl. ..... 29/895.3; 492/8; 492/9; 492/37; 492/30

(58) Field of Classification Search ..... 399/276, 399/279, 286; 29/895.3, 407.05, 407.01; 492/37, 30, 8, 9
See application file for complete search history.

(56) References Cited

U.S. PATENT DOCUMENTS

| | | | | |
|---|---|---|---|---|
| 4,189,815 | A * | 2/1980 | Seelenbinder | 226/193 |
| 4,200,389 | A * | 4/1980 | Matsui et al. | 399/339 |
| 4,425,382 | A * | 1/1984 | Tajima | 427/203 |
| 4,684,546 | A * | 8/1987 | Tokuoka et al. | 427/130 |
| 5,604,068 | A | 2/1997 | Miyamoto et al. | |
| 6,178,306 | B1 * | 1/2001 | Mizoguchi et al. | 399/276 |
| 6,546,222 | B2 | 4/2003 | Sakemi et al. | |
| 6,947,692 | B2 | 9/2005 | Kondo et al. | |
| 7,296,517 | B2 * | 11/2007 | Nishino et al. | 101/459 |
| 7,664,441 | B2 * | 2/2010 | Imamura et al. | 399/279 |

(Continued)

FOREIGN PATENT DOCUMENTS

EP 0 661 606 A2 7/1995

(Continued)

*Primary Examiner*—Essama Omgba
(74) *Attorney, Agent, or Firm*—Oblon, Spivak, McClelland, Maier & Neustadt, L.L.P.

(57) ABSTRACT

A method of manufacturing a hollow body having an external surface randomly provided with a large number of depressions is provided. The method includes providing the large number of depressions on the external surface of the hollow body. A profile curve of the external surface in a circumferential direction is obtained while rotating the hollow body. A frequency analysis is performed on the obtained profile curve. A quality of the hollow body is judged by comparing a result of the frequency analysis with a predetermined judgment standard.

1 Claim, 11 Drawing Sheets

U.S. PATENT DOCUMENTS

| | | | |
|---|---|---|---|
| 2003/0035661 | A1 | 2/2003 | Kabata et al. |
| 2003/0153249 | A1 | 8/2003 | Aoki |
| 2003/0175606 | A1 | 9/2003 | Kabata et al. |

FOREIGN PATENT DOCUMENTS

| | | | |
|---|---|---|---|
| EP | 1 762 907 | A1 | 3/2007 |
| JP | 8-160736 | | 6/1996 |
| JP | 2934129 | | 5/1999 |
| JP | 2000-347506 | | 12/2000 |
| JP | 2001-138207 | | 5/2001 |
| JP | 2004-163906 | | 6/2004 |
| JP | 2007-86091 | | 4/2007 |

* cited by examiner

METHOD OF MANUFACTURING A HOLLOW BODY USED IN AN IMAGE FORMING APPARATUS

CROSS-REFERENCE TO RELATED APPLICATIONS

The present application is a division of application Ser. No. 11/775,455, filed on Jul. 10, 2007, now U.S. Pat. No. 7,664,441, which claims priority from Japanese Patent Application No. 2006-188854, filed with the Japanese Patent Office on Jul. 10, 2006, and Japanese Patent Application No. 2007-170475, filed with the Japanese Patent Office on Jun. 28, 2007, the contents of each of which are incorporated herein by reference in its entirety.

BACKGROUND OF THE INVENTION

1. Technical Field of the Invention

The present invention relates to a developer holding member, a development device, a process cartridge and an image forming apparatus, which are used, for example, in a copy machine, a facsimile, a printer or the like. More precisely, the present invention relates to a developer holding member and a development device that form a toner image by conveying a developer held in the developer holding member to a development area where an electrostatic latent image holding member and the developer holding member face each other with a gap therebetween, and then by developing an electrostatic latent image on the electrostatic latent image holding member, and also relates to a process cartridge and an image forming apparatus including the development device. Moreover, the present invention relates to a method of manufacturing a hollow body constituting an external surface of the developer holding member.

2. Description of the Related Art

Various development devices that form images by use of a so-called two-component developer (hereinafter, simply referred to as a developer) containing a toner and magnetic carriers are used in image forming apparatuses such as a copy machine, a facsimile and a printer (see Japanese Patent Application Laid-open Publication No. 2000-347506). Such a type of development device includes a developing roller as a developer holding member that forms toner images by conveying a developer to a development area facing a photosensitive drum as an electrostatic latent image holding member, and then by developing, with the developer, electrostatic latent images formed on the photosensitive drum.

This developing roller includes a developing sleeve and a magnet roller housed in the developing sleeve. The developing sleeve is composed of a non-magnetic material formed in a cylindrical shape. The magnet roller forms a magnetic field for the purpose of causing the developer to form magnetic brushes on a surface of the developing sleeve. When the developer forms the magnetic brushes in the developing roller, the magnetic carriers form chains on the developing sleeve, along lines of magnetic force generated by the magnet roller, and the toner particles adhere to the magnetic carrier chains.

As a method of improving accuracy and durability of a developing roller of this type, Japanese Patent Application Laid-open Publication No. Hei 8-160736 proposes a structure of a developing sleeve including a large number of ridge-like protrusions each having a polygonal shape, and including fine asperities in the portions other than the ridge-like protrusions, and a method of obtaining the asperities by forming a conductive resin coating film, a metallic treatment layer and the like on the developing sleeve.

The structure described in JP-A No. Hei 8-160736, however, has problems that a malfunction such as a decrease in development performance is caused by adhesion of a toner contained in a developer to fine asperity areas when the developing roller is continuously used, and that the manufacturing processing for the developing roller is complicated by its structure.

SUMMARY OF THE INVENTION

The present invention has been made in consideration of the above background, and aims to provide a developer holding member capable of forming, over a long duration, high quality images free from density unevenness that would be caused due to a decrease in development performance, and to provide a method of manufacturing a hollow body that constitutes an external surface of the developer holding member. Moreover, the present invention aims to provide a development device, a process cartridge and an image forming apparatus, each including such a developer holding member.

A first aspect of the invention involves a developer holding member including a magnetic field generating device and a hollow body including the magnetic field generating device thereinside, and attracting a developer to an external surface thereof with magnetic force of the magnetic field generating device. The external surface of the hollow body is randomly provided with a large number of depressions. Moreover, when a spectrum is figured out by performing a frequency analysis using a profile curve in a circumferential direction of the external surface, the peak intensity of the spectrum within a range of wavelengths not more than 1 mm is not more than 12.

Preferably, the peak intensity of the spectrum within the range of wavelengths not more than 1 mm is not more than 10.

Advantageously, the large number of depressions are formed by random collisions of line-shaped grains with the external surface of the hollow body.

A second aspect of the present invention involves a development device including the developer holding member according to the present invention.

Preferably, the developer contains a magnetic particle of the grain size within a range of 20 μm to 50 μm inclusive.

Advantageously, the magnetic particle has a structure including a resin coating film with which a core member made of a magnetic material is coated. In addition, the resin coating film contains a charging control agent and a resin ingredient obtained by making cross-links between a melamine resin and a thermoplastic resin such as acryl.

A third aspect of the present invention involves a process cartridge including the development device according to the present invention.

A fourth aspect of the present invention involves an image forming apparatus including the process cartridge according to the present invention.

A fifth aspect of the present invention involves a method of manufacturing a hollow body used for manufacturing a hollow body randomly provided with a large number of depressions on an external surface thereof. The method includes the steps of: providing the large number of depressions on the external surface of the hollow body; obtaining a profile curve of the external surface in a circumferential direction while rotating the hollow body; performing a frequency analysis on the obtained profile curve; and judging a quality of the hollow body by comparing a result of the frequency analysis with a predetermined judgment standard.

DETAILED DESCRIPTION OF PREFERRED EMBODIMENTS

Figure 1:
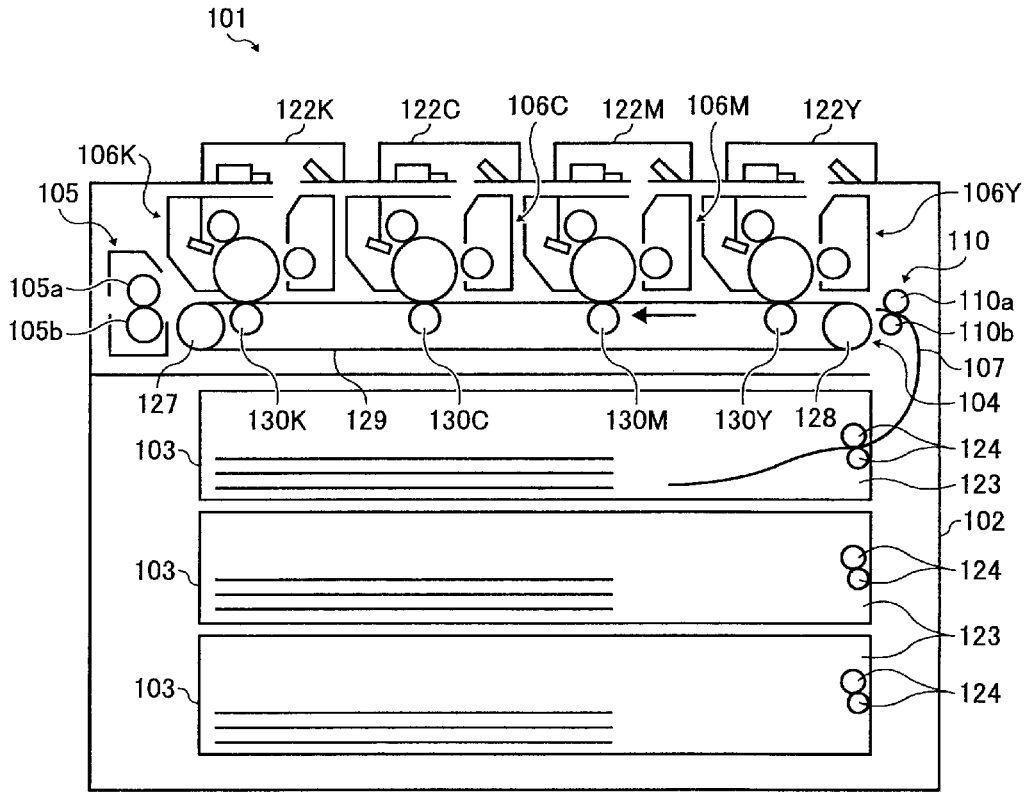
FIG. 1 is an explanatory view showing a structure of an image forming apparatus according to an embodiment of the present invention when viewed from the front.
Figure 2:
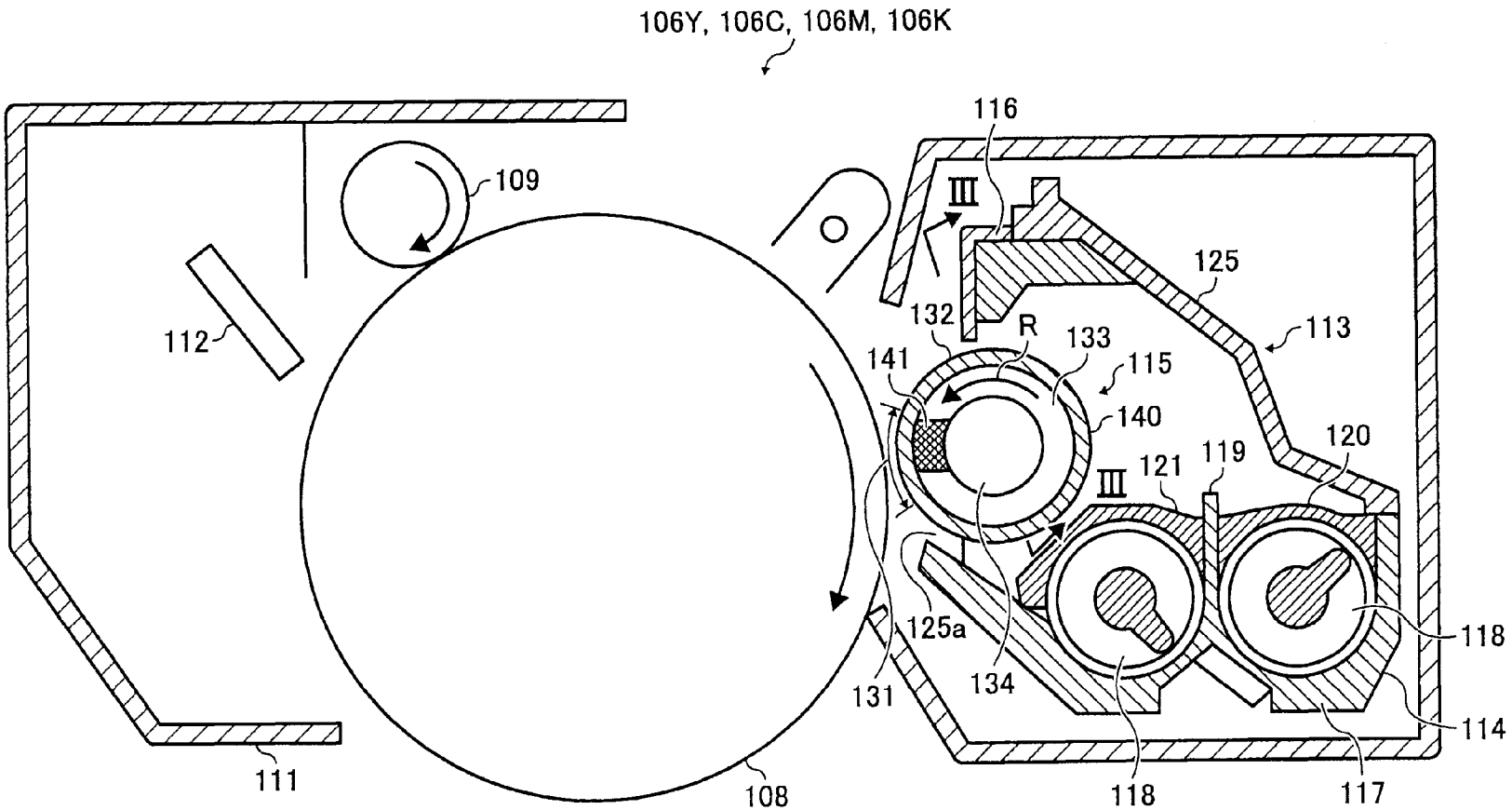
FIG. 2 is a cross sectional view of a development device of the image forming apparatus shown in FIG. 1.
Figure 3:
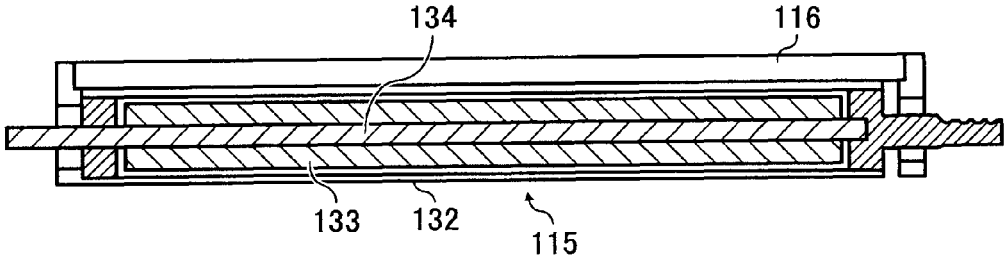
FIG. 3 is a cross sectional view taken along the line III-III in FIG. 2.
Figure 4:
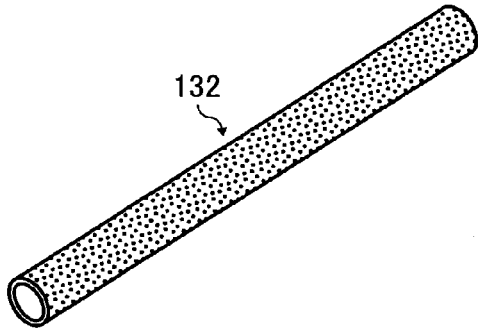
FIG. 4 is a perspective view of a developing sleeve of image forming apparatus shown in FIG. 1.
Figure 5:
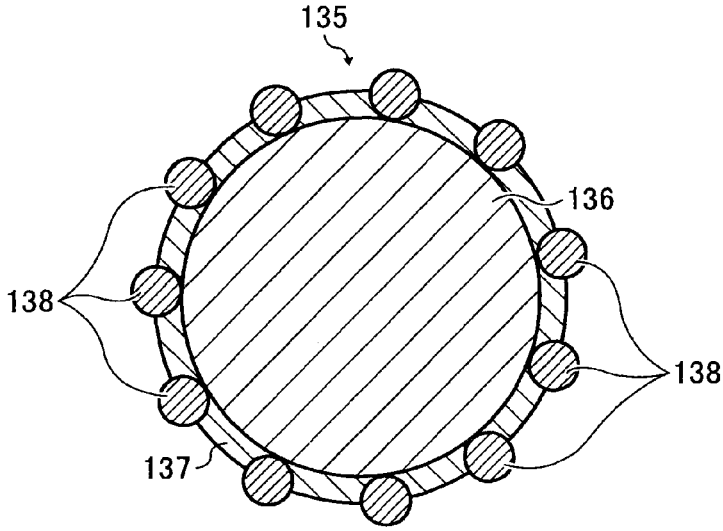
FIG. 5 is a cross sectional view of a magnetic carrier in a developer for the development device shown in FIG. 2.
Figure 6:
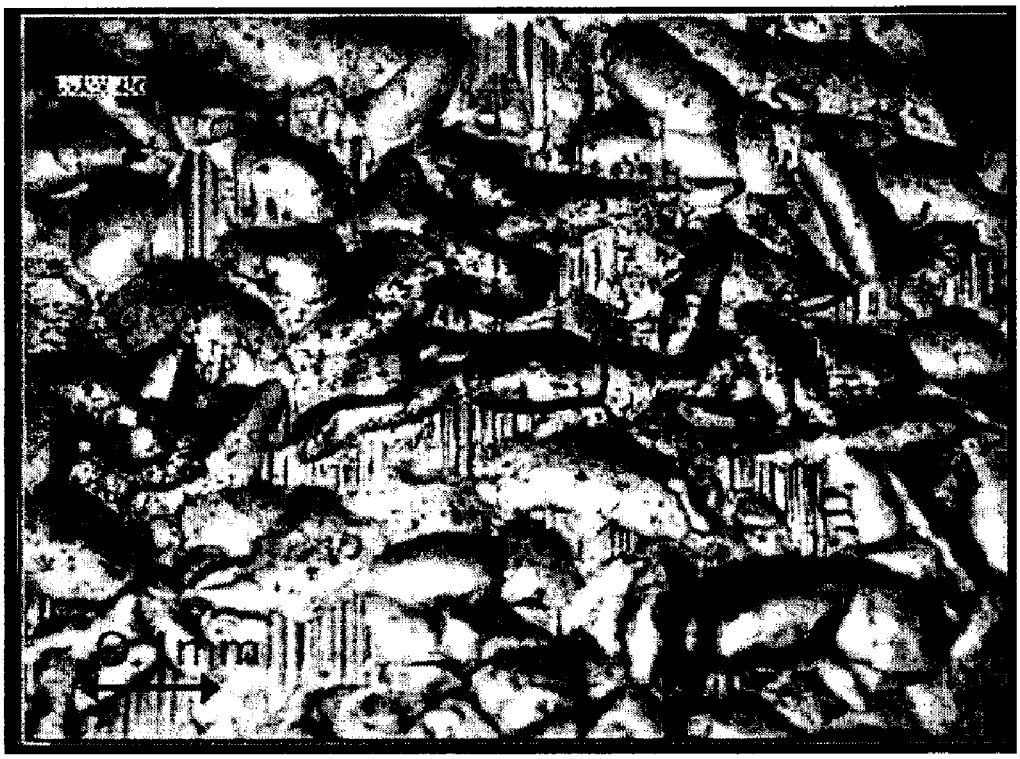
FIG. 6 is an explanatory view showing the magnified external surface of the developing sleeve shown in FIG. 4.
Figure 7:
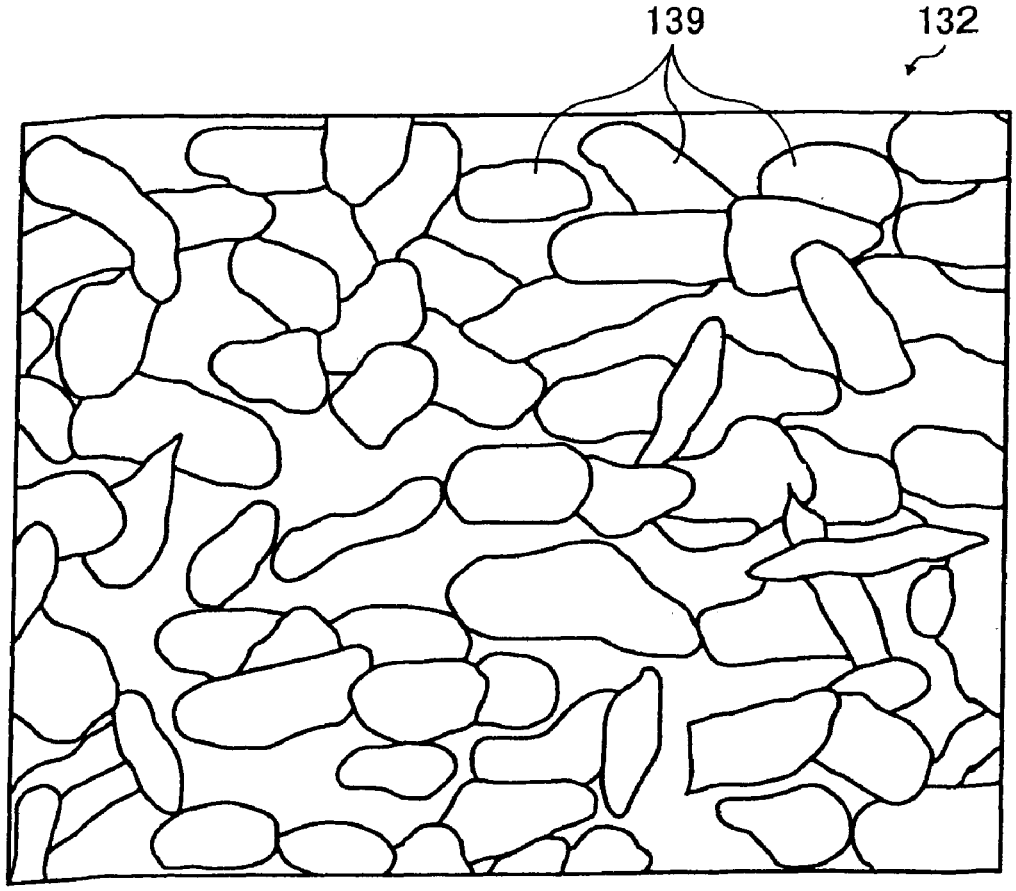
FIG. 7 is an explanatory diagram schematically showing the external surface of the developing sleeve shown in FIG. 6.
Figure 8:
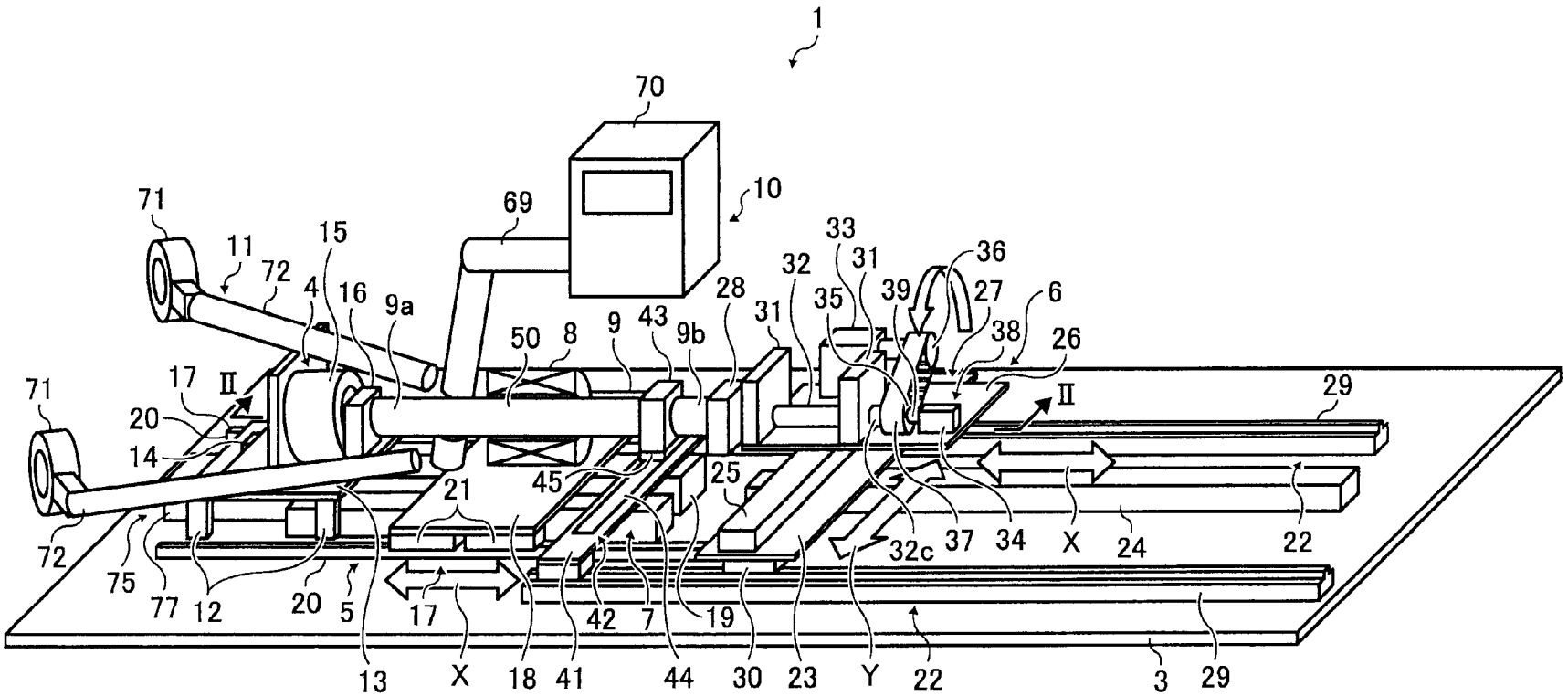
FIG. 8 is a perspective view showing a schematic configuration of a surface processing apparatus that performs a roughening process on the external surface of the developing sleeve shown in FIG. 4.
Figure 9:
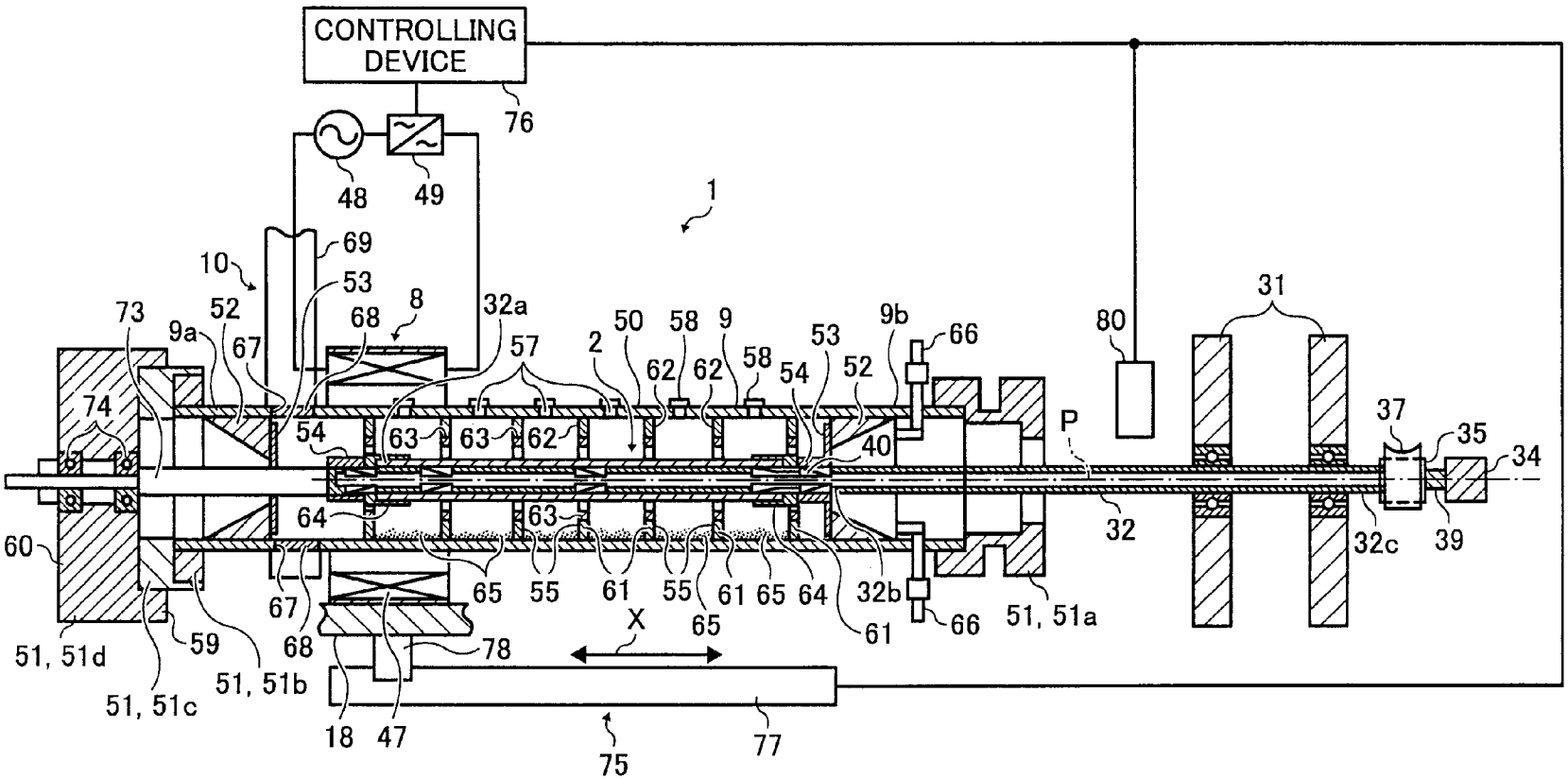
FIG. 9 is a cross sectional view taken along the line II-II in FIG. 8.
Figure 10:
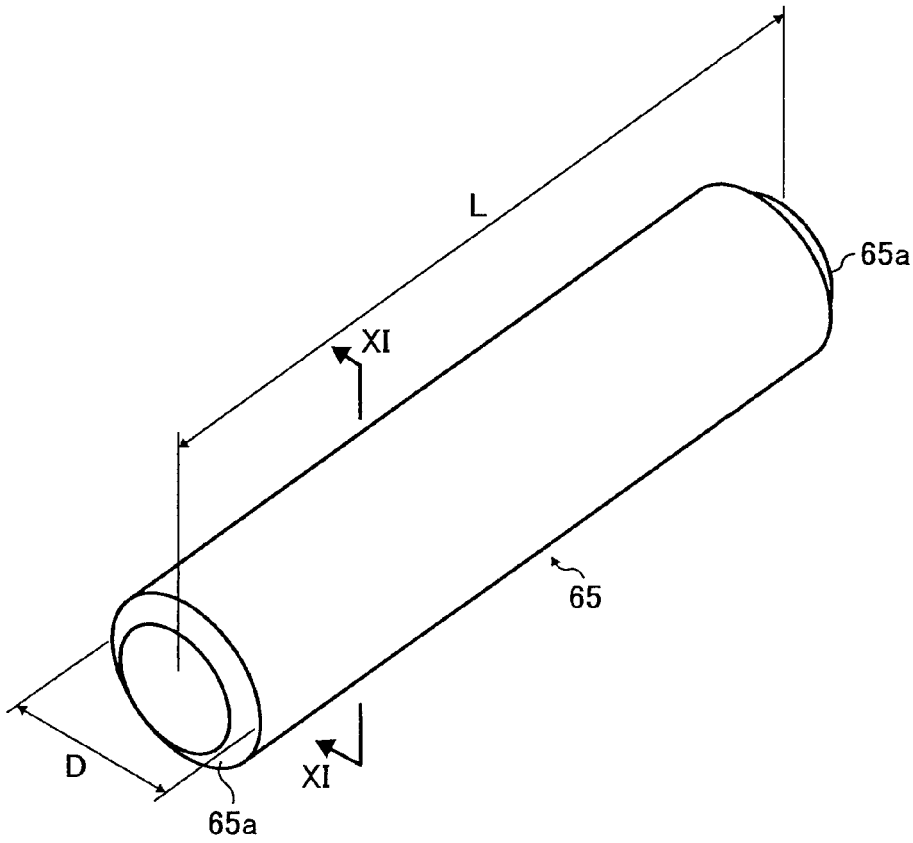
FIG. 10 is a perspective view of a magnetic abrasive grain used in the surface processing apparatus shown in FIG. 8.
Figure 11:
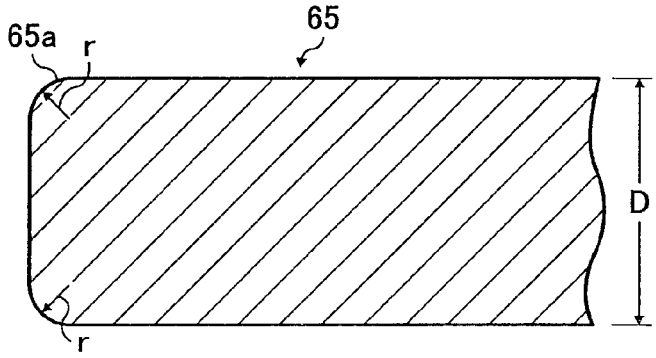
FIG. 11 is a cross sectional view taken along the line XI-XI in FIG. 10.
Figure 12:
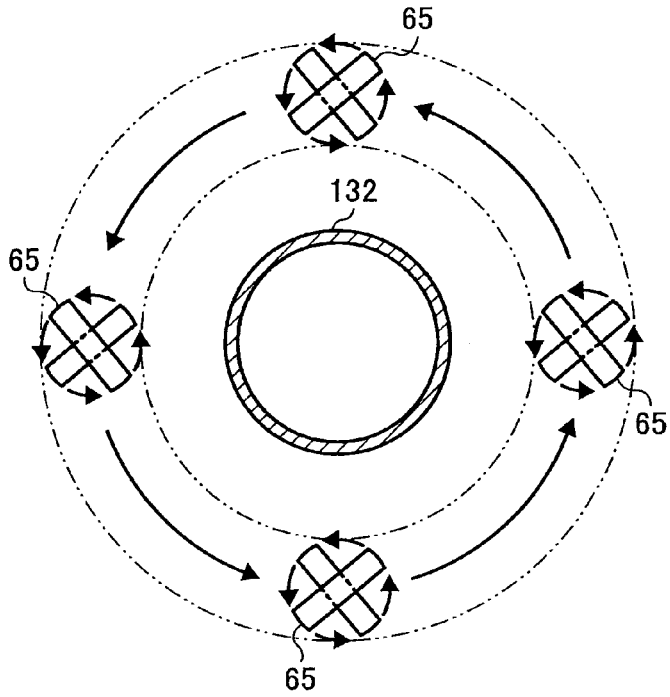
FIG. 12 is an explanatory diagram showing the developing sleeve of the surface processing apparatus shown in FIG. 8, and magnetic abrasive grains each of which revolves around the developing sleeve while rotating on its own axis.
Figure 13:
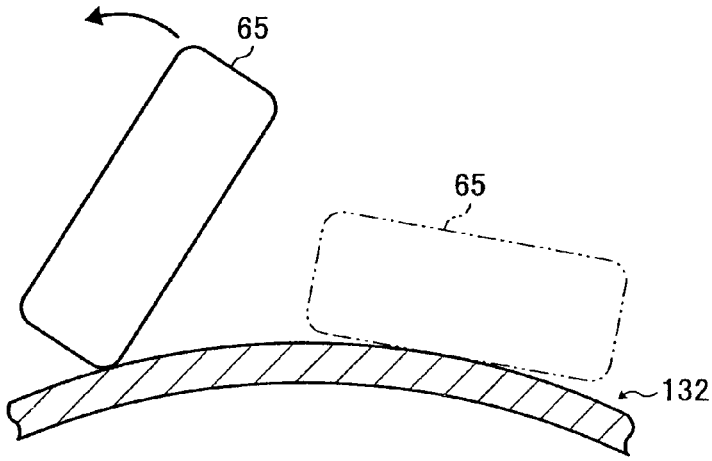
FIG. 13 is an explanatory diagram showing a state in which the magnetic abrasive grains shown in FIG. 12 collide with the external surface of the developing sleeve.
Figure 14:
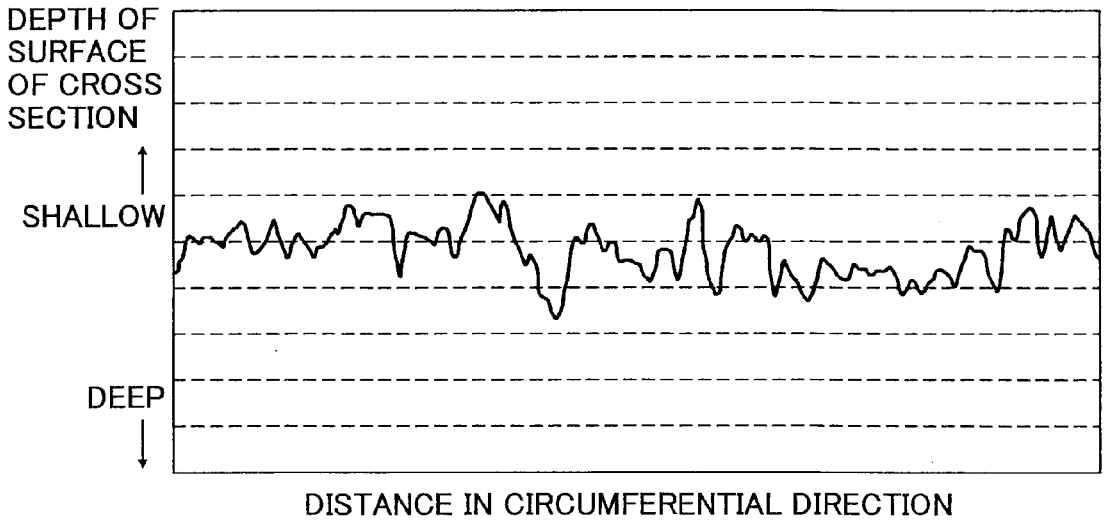
FIG. 14 is an explanatory diagram showing an example of a profile curve of the developing sleeve in a circumferential direction.
Figure 15:
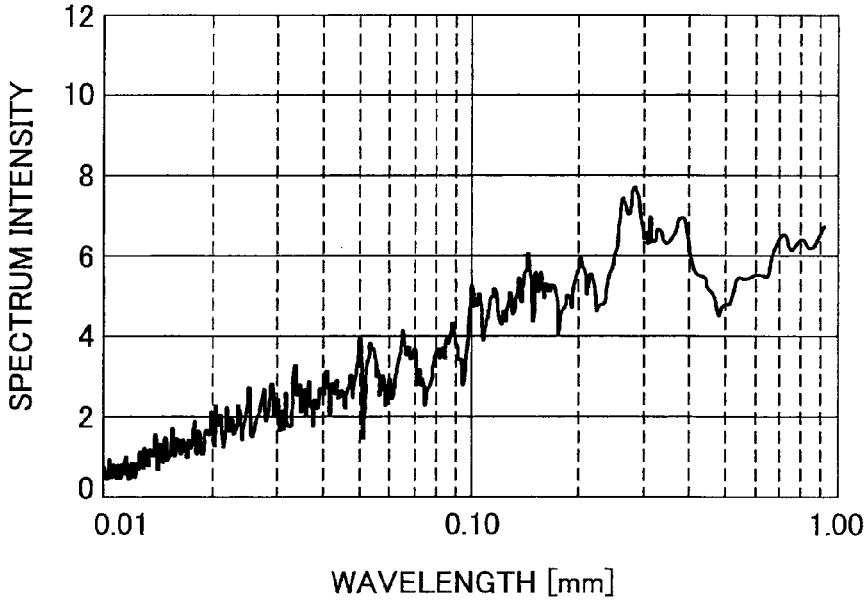
FIG. 15 is an explanatory diagram showing an example of a spectrum of wavelengths obtained by performing a fast Fourier transform (FFT) on the profile curve shown in FIG. 14.
Figure 16:
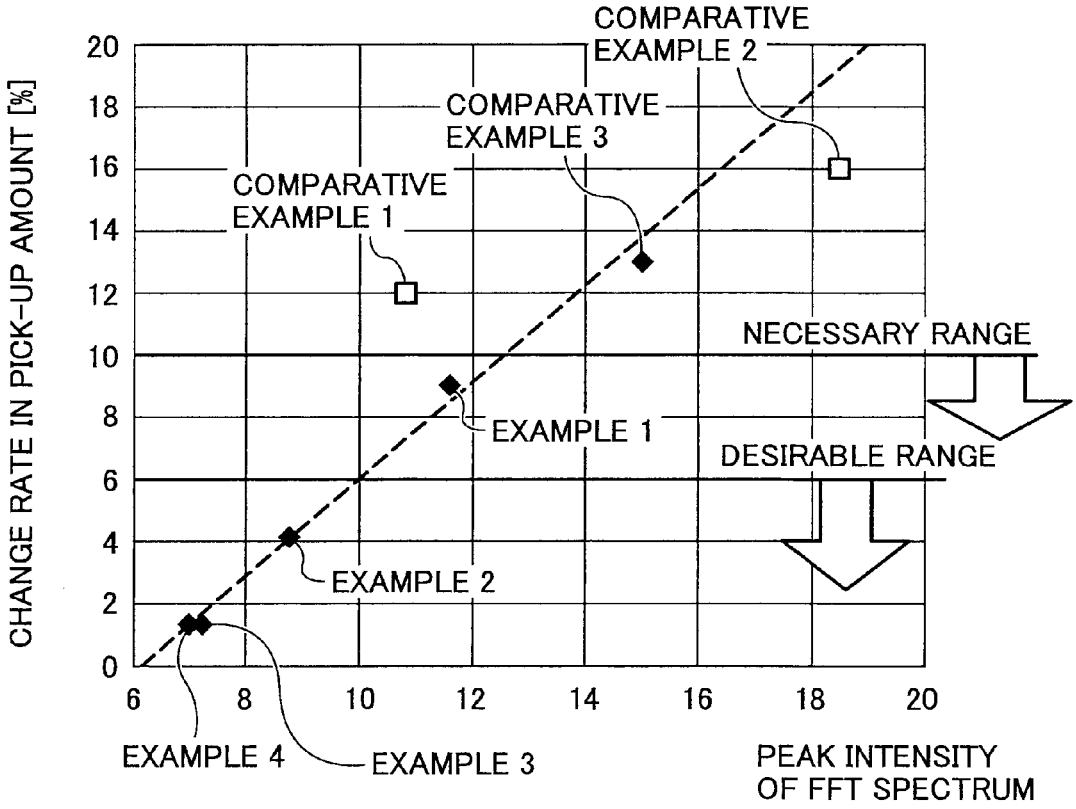
FIG. 16 is a diagram explaining relationships each between a peak intensity of FFT spectrum and a change rate in a pick-up amount of the external surface of a developing sleeve, by comparing developing sleeves roughened by the roughening process with the surface processing apparatus shown in FIG. 8, with developing sleeves roughened by roughening processes by sandblasting and bead blasting, respectively.

Hereinafter, an embodiment of the present invention will be described by referring to FIGS. 1 to 16. FIG. 1 is an explanatory view showing a structure of an image forming apparatus according to the embodiment of the present invention when viewed from the front. FIG. 2 is a cross sectional view of a development device of the image forming apparatus shown in FIG. 1, according to the embodiment of the present invention. FIG. 3 is a cross sectional view taken along the line in FIG. 2. FIG. 4 is a perspective view of a developing sleeve as a developer holding member of the development device shown in FIG. 3. FIG. 5 is a cross sectional view of a magnetic carrier in a developer for the development device shown in FIG. 2. FIG. 6 is an explanatory view showing the magnified external surface of the developing sleeve shown in FIG. 4. FIG. 7 is an explanatory diagram schematically showing the external surface of the developing sleeve shown in FIG. 6. FIG. 8 is a perspective view showing a schematic configuration of a surface processing apparatus that performs a roughening process on the external surface of the developing sleeve shown in FIG. 4. FIG. 9 is a cross sectional view taken along the line II-II in FIG. 8. FIG. 10 is a perspective view of a magnetic abrasive grain used in the surface processing apparatus shown in FIG. 8. FIG. 11 is a cross sectional view taken along the line XI-XI in FIG. 10. FIG. 12 is an explanatory diagram showing the developing sleeve of the surface processing apparatus shown in FIG. 8, and magnetic abrasive grains each of which revolves around the developing sleeve while rotating on its own axis. FIG. 13 is an explanatory diagram showing a state in which the magnetic abrasive grains shown in FIG. 12 collide with the external surface of the developing sleeve. FIG. 14 is an explanatory diagram showing an example of a profile curve of the developing sleeve in a circumferential direction. FIG. 15 is an explanatory diagram showing an example of a spectrum of wavelengths obtained by performing a fast Fourier transform (FFT) on the profile curve shown in FIG. 14. FIG. 16 is a diagram explaining relationships each between a peak intensity of FFT spectrum and a change rate in a pick-up amount of the external surface of a developing sleeve, by comparing developing sleeves roughened by the roughening process with the surface processing apparatus shown in FIG. 8, with developing sleeves roughened by roughening processes by sandblasting and bead blasting, respectively.

An image forming apparatus 101 forms images respectively of yellow (Y), magenta (M), cyan (C), block (K) colors, that is, a color image on a recording sheet 107 (shown in FIG. 1) as a transfer material. Note that units of the respective yellow, magenta, cyan, black colors are described below with reference numerals to which suffixes Y, M, C and K are respectively attached.

As shown in FIG. 1, the image forming apparatus 101 includes at least an apparatus main body 102, a sheet feeding unit 103, a resist roller pair 110, a transfer unit 104, a fixation unit 105, a plurality of laser writing units 122Y, 122M, 122C and 122K and a plurality of process cartridges 106Y, 106M, 106C and 106K.

The apparatus main body 102 is formed in a box-like shape, for example, and is installed on a floor or the like. In the apparatus main body 102, housed are the sheet feeding unit 103, the resist roller pair 110, the transfer unit 104, the fixation unit 105, the plurality of laser writing units 122Y, 122M, 122C and 122K and the plurality of process cartridges 106Y, 106M, 106C and 106K.

A plurality of the sheet feeding units 103 are provided in a lower portion of the apparatus main body 102. The sheet feeding unit 103 accommodates stacked recording sheets 107, and includes a sheet feeding cassette 123, which can be freely taken in and out of the apparatus main body 102, and sheet feeding rollers 124. The sheet feeding rollers 124 are pressed against the top sheet of the recording sheets 107 in the sheet feeding cassette 123. The sheet feeding rollers 124 feed the top sheet of recording sheets 107 to a space between a conveyance belt 129, which will be described later, of the transfer unit 104, and photosensitive drums 108 of development devices 113, which will be described later, for the respective process cartridges 106Y, 106M, 106C and 106K.

The resist roller pair 110 is provided in a conveyance path of the recording sheet 107 conveyed from the sheet feeding unit 103 to the transfer unit 104, and includes a pair of rollers

110*a* and 110*b*. The resist roller pair 110 sandwiches the recording sheet 107 between the pair of rollers 110*a* and 110*b*, and feeds the sandwiched recording sheet 107 into the space between the transfer unit 104 and the process cartridges 106Y, 106M, 106C and 106K at timings that allow toner images to be completely overlapped with one another.

The transfer unit 104 is provided above the sheet feeding units 103. The transfer unit 104 includes a driving roller 127, a driven roller 128, the conveyance belt 129 and transfer rollers 130Y, 130M, 130C and 130K. The driving roller 127 is disposed downstream in the conveying direction of the recording sheet 107, and is driven to rotate by a motor serving as a drive source. The driven roller 128 is rotatably supported by the apparatus main body 102, and is disposed upstream in the conveying direction of the recording sheet 107. The conveyance belt 129 is formed in an annular shape having no end, and is suspended by both the driving roller 127 and the driven roller 128 described above. When the driving roller 127 is driven to rotate, the conveyance belt 129 rotates (seamlessly runs) around the drive roller 127 and the driven roller 128 in the anticlockwise direction in FIG. 1.

The conveyance belt 129 and the recording sheet 107 conveyed on the conveyance belt 129 are sandwiched between the transfer rollers 130Y, 130M, 130C and 130K and the photosensitive drums 108 of the respective process cartridges 106Y, 106M, 106C and 106K. In the transfer unit 104, the transfer rollers 130Y, 130M, 130C and 130K cause toner images on the photosensitive drums 108 of the process cartridges 106Y, 106M, 106C and 106K to be transferred onto the recording sheet 107 fed from the sheet feeding unit 103, by pressing the recording sheet 107 against the external surfaces of the photosensitive drums 108. The transfer unit 104 conveys the recording sheet 107, onto which the toner images have been transferred, to the fixation unit 105.

The fixation unit 105 is provided downstream of the transfer unit 104 in the conveying direction of the recording sheet 107, and includes a pair of rollers 105*a* and 105*b* between which the recording sheet 107 is sandwiched. The fixation unit 105 fixes the toner image, which has been transferred to the recording sheet 107 from the photosensitive drums 108, on the recording sheet 107 conveyed from the transfer unit 104 by pressing and heating the recording sheet 107 between the pair of rollers 105*a* and 105*b*.

The laser writing units 122Y, 122M, 122C and 122K are each attached to the upper surface of the apparatus main body 102. The laser writing units 122Y, 122M, 122C and 122K correspond to the process cartridges 106Y, 106M, 106C and 106K, respectively. The laser writing units 122Y, 122M, 122C and 122K form electrostatic latent images by respectively irradiating, with laser beams, the external surfaces of the photosensitive drums 108 uniformly charged by charging rollers 109, to be described later, of the process cartridges 106Y, 106M, 106C and 106K.

The process cartridges 106Y, 106M, 106C and 106K are provided between the transfer unit 104 and the respective laser writing units 122Y, 122M, 122C and 122K. The process cartridges 106Y, 106M, 106C and 106K are detachably attached to the apparatus main body 102. The process cartridges 106Y, 106M, 106C and 106K are disposed in a line along the conveying direction of the recording sheet 107.

As shown in FIG. 2, the process cartridges 106Y, 106M, 106C and 106K each include a cartridge case 111, the charging roller 109 as a charging device, the photosensitive drum 108 as an electrostatic latent image holding member, a cleaning blade 112 serving as a cleaning device, and a development device 113. Accordingly, the image forming apparatus 101 includes at least the charging rollers 109, the photosensitive drums 108, the cleaning blades 112 and the development devices 113.

The cartridge case 111 is detachably attached to the apparatus main body 102, and houses the charging roller 109, the photosensitive drum 108, the cleaning blade 112 and the development device 113 therein. The charging roller 109 uniformly charges the external surface of the photosensitive drum 108. The photosensitive drum 108 is disposed, with a gap, near a developing roller 115 of the development device 113, which will be described later. The photosensitive drum 108 is formed in a columnar or cylindrical shape capable of rotating about the axial center. An electrostatic latent image is formed on the external surface of the photosensitive drum 108 by a corresponding one of the laser writing units 122Y, 122M, 122C and 122K. The photosensitive drum 108 develops the electrostatic latent image formed on and held by the external surface, by attracting the toner to the latent image, and then transfers the toner image thus obtained to the recording sheet 107 positioned between the photosensitive drum 108 and the conveyance belt 129. After the toner image is transferred to the recording sheet 107, the cleaning blade 112 removes the post-transfer residual toner remaining on the external surface of the photosensitive drum 108.

As shown in FIG. 2, the development device 113 includes at least a developer supply unit 114, a case 125, the developing roller 115 as a developer holding member, and a control blade 116 as a controlling member.

The developer supply unit 114 includes a container 117 and a pair of stir screws 118 as a stirring member. The container 117 is formed in a box-like shape having a substantially same length as that of the photosensitive drum 108. Moreover, a partitioning wall 119 extending along a longitudinal direction of the container 117 is provided in the container 117. The partitioning wall 119 divides the inside of the container 117 into a first space 120 and a second space 121. In addition, the first space 120 and the second space 121 are communicated with each other at both ends thereof.

The container 117 accommodates the developer in both of the first space 120 and the second space 121. The developer contains a toner and magnetic carriers or magnetic particles 135 (also called magnetic powders, and its cross section is shown in FIG. 5). The toner is supplied, as needed, to a first end portion of the first space 120 that is positioned farther away form the developing roller 115 than the second space 121 is. The toner includes fine particles each of which has a spherical shape, and which are manufactured by using an emulsion polymerization method or a suspension polymerization method. Note that the toner may be obtained by crushing, into fine pieces, a mass of synthetic resin obtained by mixing and scattering various types of dyes or pigments. The average particle diameter of the toner is from 3 μm to 7 μm inclusive. Thus, the toner may be manufactured by crushing processing or the like.

The magnetic carriers 135 are contained in both of the first space 120 and the second space 121. The average particle diameter of the magnetic carrier 135 is from 20 μm to 50 μm inclusive. As shown in FIG. 5, the magnetic carrier 135 includes a core member 136, a resin coating film 137 coating the external surface of the core member 136, and alumina particles 138 scattered on the resin coating film 137.

The core member 136 is made of a ferrite that is a magnetic material, and formed in a spherical shape. The entire external surface of the core member 136 is coated with the resin coating film 137. The resin coating film 137 contains a charging control agent and a resin ingredient obtained by making cross-links between a melamine resin and a thermoplastic resin such as acryl. This resin coating film 137 has elasticity and strong adhesiveness. The alumina particle 138 is formed in a spherical shape having the outer diameter grater than the thickness of the resin coating film 137. The alumina particles 138 are held with the strong adhesiveness of the resin coating film 137. Each alumina particle 138 protrudes in an outward direction of the magnetic carrier 135 from the resin coating film 137.

The stir screws 118 are housed in the first space 120 and the second space 121, respectively. The longitudinal directions of the stir screws 118 are parallel to the longitudinal directions of the container 117, the developing roller 115 and the photosensitive drum 108. The stir screw 118 is provided so as to be rotatable about the axial center. The stir screw 118 stirs the toner and the magnetic carriers 135 and conveys the developer along the axial center while rotating about the axial center.

In the case shown in FIG. 2, the stir screw 118 in the first space 120 conveys the developer from the aforementioned first end portion to the second end portion. On the other hand, the stir screw 118 in the second space 121 conveys the developer from the second end portion to the first end portion.

According to the aforementioned structure, the developer supply unit 114 conveys the toner, which is supplied to the first end portion, to the second end portion of the first space 120 while mixing with the magnetic carriers 135, and then conveys the toner and the magnetic carriers 135 from the second end portion of the first space 120 to the second end portion of the second space 121. Then, the developer supply unit 114 supplies the toner and the magnetic carriers 135 to the external surface of the developing roller 115 while mixing them in the second space 121 and conveying them in the axial center direction.

The case 125 is formed in a box-like shape, and is attached to the container 117 of the developer supply unit 114, which is above mentioned. In this way, the developing roller 115 and the container 117 are covered with the case 125. Moreover, the case 125 is provided with an opening portion 125*a* in a portion of the case 125 facing the photosensitive drum 108.

The developing roller 115 is formed in a columnar shape, and provided between the second space 121 and the photosensitive drum 108, as well as near the aforementioned opening portion 125*a*. The developing roller 115 is parallel to both of the photosensitive drum 108 and the container 117. The developing roller 115 is disposed near the photosensitive drum 108 with a gap.

As shown in FIG. 3, the developing roller 115 includes a cored bar 134, a cylindrical magnet roller 133 (also called a magnetic member) as a magnetic field generation device, that is, a cylindrical magnetic field generation device, and a cylindrical developing sleeve 132 as a hollow body. The cored bar 134 is disposed so that its longitudinal direction is parallel to the longitudinal direction of the photosensitive drum 108, and is fixed to the case 125 in an unrotatable manner.

The magnet roller 133 is composed of a magnetic material, and is formed in a cylindrical shape. In addition, a plurality of unillustrated fixed magnetic poles are attached to the magnet roller 133. The magnet roller 133 is fixed to the outer circumference of the cored bar 134, and thereby is not allowed to rotate about the axial center.

Each fixed magnetic pole is a magnet with a long bar-like shape, and is attached to the magnet roller 133. The fixed magnetic pole extends along the longitudinal direction of the magnet roller 133, i.e., the developing roller 115, and is provided throughout the length of the magnet roller 133. The magnet roller 133 having the foregoing structure is housed (is entirely included) in the developing sleeve 132.

One of the fixed magnetic poles faces the aforementioned stir screws 118. The fixed magnetic pole is a pick-up magnetic pole that generates magnetic force on the external surface of the developing sleeve 132, i.e., the developing roller 115, and that thereby causes the developer in the second space 121 of the container 117 to adhere to the external surface of the developing sleeve 132.

Another fixed magnetic pole faces the aforementioned photosensitive drum 108. This fixed magnetic pole is a development magnetic pole that forms a magnetic field between the developing sleeve 132 and the photosensitive drum 108 by generating magnetic force on the external surface of the developing sleeve 132, i.e., the developing roller 115. This fixed magnetic pole forms magnetic brushes by the use of the magnetic field, and thereby allows the toner in the developer, adhering to the external surface of the developing sleeve 132, to be transferred to the photosensitive drum 108.

At least one fixed magnetic pole is provided between the aforementioned pick-up magnetic pale and development magnetic pole. By generating magnetic force on the external surface of the developing sleeve 132, i.e., the developing roller 115, the at least one fixed magnetic pole conveys the developer before development to the photosensitive drum 108, and also conveys the developer after development from the photosensitive drum 108 to the container 117.

When the developer adheres to the external surface of the developing sleeve 132, the aforementioned fixed magnetic pole causes multiple magnetic carries 135 in the developer to be gathered and stacked along lines of magnetic force generated by the fixed magnetic pole, and thereby to protrude outward from (form chains on) the external surface of the developing sleeve 132. Such a state in which the multiple magnetic carriers 135 are gathered and stacked along the lines of magnetic force, and thereby protrude outward from the external surface of the developing sleeve 132 is expressed as a phrase in which the magnetic carriers 135 form chains on the external surface of the developing sleeve 132. Then, the above-mentioned toner particles are attracted to the chains of the magnetic carriers 135. In summary, the developing sleeve 132 attracts the developer to the external surface by using the magnetic force generated by the magnet roller 133.

As shown in FIG. 4, the developing sleeve 132 is formed in a cylindrical shape. The developing sleeve 132 includes (houses) the magnet roller 133 entirely, and is provided so as to be rotatable about the axial center. The developing sleeve 132 is rotated so that the inner surface thereof faces the fixed magnetic poles one by one. The developing sleeve 132 is composed of a non-magnetic material such as aluminum alloy or stainless steel (SUS). The external surface of the developing sleeve 132 is roughened by the roughening process using the surface processing apparatus 1, as described above.

Aluminum alloy is excellent in terms of material workability and lightweight property. When an aluminum alloy is used, it is preferable to adopt A6063, A5056 or A3003. When an SUS is used, it is preferable to adopt SUS303, SUS304 or SUS316.

The outer diameter of the developing sleeve 132 is preferably on the order of 17 mm to 18 mm. The length of the developing sleeve 132 in the axial (axial center) direction is preferably on the order of 300 mm to 350 mm. The external surface of the developing sleeve 132 has the roughness gradually increasing (is rougher) from the center to both ends in the axial center direction of the developing sleeve 132.

In addition, as shown in FIGS. 6 and 7, the external surface of the developing sleeve 132 is provided with a large number of depressions each having a substantial oval planar shape, and formed by the roughening process. A large number (a plurality) of depressions 139 are arranged randomly on the external surface of the developing sleeve 132. Obviously, the depressions 139 include the depressions 139 each having its longitudinal direction along the axial direction of the developing sleeve 132, and the depressions 139 each having its longitudinal direction along the circumferential direction of the developing sleeve 132. The number of the depressions 139 each having its longitudinal direction along the axial direction of the developing sleeve 132 is larger than that of the depressions 139 each having its longitudinal direction along the circumferential direction of the developing sleeve 132. Moreover, the length of the depression 139 in the longitudinal direction (major axis) is from 0.05 mm to 0.3 mm inclusive, and the width in the width direction (minor axis) is from 0.02 mm to 0.1 mm inclusive. Note that the right to left direction in FIGS. 6 and 7 is the axial direction of the developing sleeve 132.

The control blade 116 is provided to an end portion of the development device 113 close to the photosensitive drum 108. The control blade 116 is attached to the foregoing case 125 with a gap between the controller blade 116 and the external surface of the developing sleeve 132. The control blade 116 shaves off part of the developer exceeding a predetermined thickness above the external surface of the developing sleeve 132, and drops it into the container 117. Thereby, the control blade 116 causes the developer, which is to be conveyed to the development area 131, on the external surface of the developing sleeve 132 to have a desired thickness.

In the development device 113 having the foregoing structure, the developer supply unit 114 sufficiently mixes the toner and the magnetic carriers 135, and the fixed magnetic poles cause the developer thus mixed to be attracted and adhere to the external surface of the developing sleeve 132. Then, in the development device 113, the developer caused to adhere to the developing sleeve 132 by the fixed magnetic poles is conveyed to the development area 131 with the rotation of the developing sleeve 132. The development device 113 causes the developer, which has been made to have the desired thickness by the control blade 116, to be attracted and adhere to the photosensitive drum 108. In this way, the development device 113 holds the developer on the developing roller 115, conveys the developer to the development area 131, and forms a toner image by developing an electrostatic latent image on the photosensitive drum 108.

Thereafter, the development device 113 removes the developer after development to the container 117. Then, the developer after development is again sufficiently mixed with the other remaining developer in the second space 121, and is used for developing electrostatic latent images on the photosensitive drum 108.

The image forming apparatus 101 having the foregoing structure forms an image on the recording sheet 107 in the following manner. Firstly, the image forming apparatus 101 rotates the photosensitive drums 108, and uniformly charges the external surfaces of the photosensitive drums 108 with the charging rollers 109. In each of the process cartridges 106Y, 106M, 106C and 106K, the external surface of the photosensitive drum 108 is irradiated with a laser beam, and thereby an electrostatic latent image is formed on the external surface of the photosensitive drum 108. Thereafter, when the electrostatic latent image is positioned in the development area 131, the developer adhering to the external surface of the developing sleeve 132 in the development device 113 is attracted and adheres to the external surface of the photosensitive drum 108. Thereby, the electrostatic latent image is developed, and the toner image is formed on the external surface of the photosensitive drum 108.

After that, the image forming apparatus 101 transfers the toner images formed on the external surfaces of the photosensitive drums 108 to the recording sheet 107 when the recording sheet 107 conveyed by the sheet feeding roller 124 of the sheet feeding unit 103 and the like is positioned between photosensitive drums 108 of the process cartridges 106Y, 106M, 106C and 106K and the conveyance belt 129 of the transfer unit 104. In the image forming apparatus 101, the fixation unit 105 fixes the toner image on the recording sheet 107. In this way, the image forming apparatus 101 forms a color image on the recording sheet 107.

Subsequently, a method of performing the roughening process on the developing sleeve 132 will be described. The external surface of the aforementioned developing sleeve 132 is roughened in the roughening process by the surface processing apparatus 1 shown in FIGS. 8 and 9.

As shown in FIGS. 8 and 9, the surface processing apparatus 1 includes a base 3, a fixed holding unit 4, an electromagnetic coil moving unit 5, a movable holding unit 6 serving as a sliding device, a movable chuck unit 7, an electromagnetic coil 8 serving as a magnetic field generation unit, a container 9, a collection unit 10, a cooling unit 11, a linear encoder 75, a controlling device 76 (shown in FIG. 9) and a reflection-type displacement gauge 80 (shown in FIG. 9).

The base 3 is formed in a plate-like shape, and is installed on a floor, a table or the like in a factory. The upper surface of the base 3 is maintained in parallel to a horizontal direction. The planar shape of the base 3 is formed in a rectangular shape.

The fixed holding unit 4 includes a plurality of columns 12, a holding base 13, a standing bracket 14, a cylindrical holding member 15 and a holding chuck 16. The columns 12 are provided to protrude from one end portion in a longitudinal direction (hereinafter, called an arrow X) of the base 3.

The holding base 13 is formed in a plate-like shape, and is attached to the top ends of the columns 12. The standing bracket 14 is formed in a plate-like shape, and provided to protrude from the holding base 13. The cylindrical holding member 15 is formed in a cylindrical shape, and is attached to the standing bracket 14 and the holding base 13. The cylindrical holding member 15 is disposed closer to the center of the base 3 than the standing bracket 14 so that its axial center is parallel to both the horizontal direction and the arrow X. Inside the cylindrical holding member 15, housed are flange members 51*b*, 51*c* and 51*d* (that is, a first end portion 9*a* of the container 9) attached to the first end portion 9*a*. The flange members 51*b*, 51*c* and 51*d* and the first end 9*a* will be described later.

The holding chuck 16 is disposed near the cylindrical holding member 15, i.e., the holding base 13, and is attached to the foregoing base 3. The holding chuck 16 chucks the container 9 whose first end portion 9*a* is housed in the cylindrical holding member 15, and thus holds the first end portion 9*a* of the container 9. The fixed holding unit 4 having the foregoing structure holds the first end portion 9*a* of the container 9.

The electromagnetic coil moving unit 5 includes a pair of liner guides 17, an electromagnetic coil holding base 18 and an electromagnetic coil moving actuator 19. The liner guides 17 include rails 20 and a slider 21. The rails 20 are arranged on the base 3. Each of the rails 20 is formed in a straight line shape, and is disposed so that its longitudinal direction is parallel to the longitudinal direction of the base 3, i.e., the arrow X. The slider 21 is supported by the rails 20 so as to be movable along the longitudinal directions of the rails 20, i.e., the arrow X. In the pair of liner guides 17, the rails 20 are disposed with a certain distance placed therebetween along a width direction (hereinafter, called an arrow Y) of the base 3. Note that the arrow X and the arrow Y are obviously orthogonal to each other, and both of them are also parallel to the horizontal direction.

The electromagnetic coil holding base 18 is formed in a plate-like shape, and is mounted on the aforementioned slider 21. The upper surface of the electromagnetic coil holding base 18 is disposed in parallel to the horizontal direction. The upper surface of the electromagnetic coil holding base 18 is provided with the electromagnetic coil 8. The electromagnetic coil moving actuator 19 is attached to the base 3, and causes the aforementioned electromagnetic coil holding base 18 to slide and move along the arrow X. The aforementioned electromagnetic coil moving unit 5 causes the electromagnetic coil holding base 18, i.e., the electromagnetic coil 8 to slide and move along the arrow X by using the electromagnetic coil moving actuator 19. In addition, the moving speed of the electromagnetic coil 8 moved by the electromagnetic coil moving unit 5 can be changed within a range of 0 mm/sec to 300 mm/sec. Moreover, the movable range of the electromagnetic coil 8 moved by the electromagnetic coil moving unit 5 is approximately 600 mm.

The movable holding unit 6 includes a pair of liner guides 22, a holding base 23, a first actuator 24, a second actuator 25, a moving base 26, a bearing rotatable unit 27 and a holding chuck 28.

The liner guides 22 include rails 29 and a slider 30. The rails 29 are disposed on the base 3. Each of the rails 29 is formed in a straight line shape, and is disposed so that its longitudinal direction is parallel to the longitudinal direction of the base 3, i.e., the arrow X. The slider 30 is supported by the rails 29 so as to be movable along the longitudinal directions of the rails 29, i.e., the arrow X. In the pair of liner guides 22, the rails 29 are disposed with a certain distance placed therebetween along the arrow Y, i.e., the width direction of the base 3.

The holding base 23 is formed in a plate-like shape, and is mounted on the aforementioned slider 30. The upper surface of the holding base 23 is disposed in parallel to the horizontal direction. The first actuator 24 is attached to the base 3, and causes the above-mentioned holding base 23 to slide and move along the arrow X.

The second actuator 25 is mounted on the holding base 23, and causes the moving base 26 to slide and move along the arrow Y. The moving base 26 is formed in a plate-like shape, and is disposed so that the upper surface thereof is parallel to the horizontal direction.

The bearing rotatable unit 27 includes a pair of bearings 31, a hollow holding member 32 serving as a core shaft, a drive motor 33 as a rotating device, and a chuck cylinder 34. The pair of bearings 31 are disposed with a distance placed therebetween along the arrow X, and are mounted on the moving base 26. The hollow holding member 32 is composed of a magnetic material, is formed in a cylindrical shape, and is supported by the bearings 31 so as to be rotatable about the axial center. The hollow holding member 32 is disposed so that the axial center thereof is parallel to the aforementioned arrow X, i.e., the axial center of the cylindrical holding member 15 of the fixed holding unit 4. The hollow holding member 32 is disposed to protrude from the moving base 26 toward the fixed holding unit 4 so that a first end portion 32*a* of the hollow holding member 32 is located in the container 9, and also that a second end portion 32*c* thereof is located on the moving base 26. As shown in FIG. 9, the hollow holding member 32 is inserted in a cylindrical process target object 2. In addition, a pulley 35 is fixed to the second end portion 32*c* of the hollow holding member 32 located on the moving base 26. The pulley 35 is disposed coaxially with the hollow holding member 32.

The drive motor 33 is mounted on the moving base 26, and a pulley 36 is attached to an output shaft of the drive motor 33. The axial center of the output shaft of the drive motor 33 is parallel to the arrow X. A timing belt 37 having no end is suspended by both of the foregoing pulleys 35 and 36. The drive motor 33 rotates the hollow holding member 32 about the axial center. By rotating the hollow holding member 32 about the axial center, the drive motor 33 rotates the process target object 2 about the axial center of the hollow holding member 32 parallel to the longitudinal direction of the container 9. In other words, the drive motor 33 functions as a rotating device recited in the scope of claims.

The chuck cylinder 34 includes a cylinder body 38 mounted on the moving base 26, and a chuck shaft 39 slidably provided to the cylinder body 38. The chuck shaft 39 is formed in a columnar shape, and is disposed so that its longitudinal direction is parallel to the arrow X. The chuck shaft 39 is housed in the hollow holding member 32, and is arranged coaxially with the hollow holding member 32. A plurality of pairs of chuck nails 40 are attached to the chuck shaft 39.

A pair of chuck nails 40 are attached to the chuck shaft 39 so as to protrude from the outer circumferential surface of the chuck shaft 39 in an outer direction of the chuck shaft 39. Moreover, the chuck nails 40 are capable of protruding from the outer circumferential surface of the hollow holding member 32 in an outer direction of the hollow holding member 32. The pair of chuck nails 40 are provided so that the protruding amounts from the chuck shaft 39 and the hollow holding member 32 can be changed freely. The plurality of pairs of chuck nails 40 are disposed at intervals along the longitudinal direction of the foregoing chuck shaft 39, i.e., the arrow X. As the chuck shaft 39 shrinks toward the cylinder body 38, the protruding amounts of a pair of chuck nails 40 from the chuck shaft 39 and the hollow holding member 32 increase.

The above chuck cylinder 34 causes the chuck nails 40 to further protrude in the outer direction of the chuck shaft 39 with a shrinkage of the chuck shaft 39 toward the cylinder body 38. As a result, the chuck nails 40 are pressed against the inner surface of the process target object 2 mounted on the outer circumference of the hollow holding member 32. Thereby, the chuck cylinder 34 fixes the chuck shaft 39, the hollow holding member 32 and the process target object 2 by using the chuck nails 40. In other words, the process target object 2 is held while its external surface, which is a plane to be subjected to the roughening process, is being exposed. At this time, as a matter of course, the chuck shaft 39, the hollow holding member 32, the process target object 2, and a later-described cylindrical member 50, i.e., the container 9 are coaxial with each other.

The aforementioned chuck cylinder 34 and chuck nails 40 hold the process target object 2 coaxially with the hollow holding member 32 and the container 9. Precisely, the chuck cylinder 34 and chuck nails 40 hold the process target object 2 so that the external surface, which is a plane to be subjected to the roughening process, of the process target object 2 would be exposed in the center of the container 9. The foregoing chuck cylinder 34, chuck nails 40 and hollow holding member 32 form a holding device.

The holding chuck 28 is mounted on the above-mentioned moving base 26. The holding chuck 28 chucks a later-described flange member 51*a* attached to a second end portion 9*b* of the container 9, and thereby holds the second end portion 9*b* of the container 9. The holding chuck 28 controls the rotation of the container 9 about its axial center.

By the use of the actuators 24 and 25, the movable holding unit 6 having the foregoing structure moves the holding chuck 28, the hollow holding member 32 and the like along the arrows X and Y that are orthogonal to each other. In short, the movable holding unit 6 moves the container 9 held by the holding chuck 28 along the arrows X and Y.

The movable chuck unit 7 includes a holding base 41, a liner guide 42 and a holding chuck 43. The holding base 41 is fixed to one end portion of the pair of rails 29 of the liner guides 22, which is the end closer to the fixed holding unit 4. The holding base 41 is formed in a plate-like shape, and is disposed so that its upper surface is parallel to the horizontal direction.

The liner guide 42 includes rails 44 and a slider 45. The rails 44 are mounted on the holding base 41. Each of the rails 44 is formed in a straight line shape, and is disposed so that its longitudinal direction is parallel to the arrow Y, i.e., the width direction of the base 3. The slider 45 is supported by the rails 44 so as to be movable along the longitudinal directions of the rails 44, i.e., the arrow Y.

The holding chuck 43 is mounted on the slider 45. The holding chuck 43 is located between the aforementioned holding chucks 16 and 28. The holding chuck 43 holds the container 9 by chucking a portion close to the second end portion 9*b* of the container 9. The foregoing movable chuck unit 7 positions the container 9 by causing the holding chuck 43 to hold the container 9. Moreover, when the container 9 moves along the axial center, the movable chuck unit 7 prevents the container 9 from falling from the bearing rotatable unit 27, i.e., the surface processing apparatus 1, in such a way that the holding chuck 43 holds the container 9 in corporation with the above-mentioned holding chuck 28.

As shown in FIG. 9, the electromagnetic coil 8 includes an outer cover 46 formed in a cylindrical shape, and a plurality of coil units 47 disposed inside the outer cover 46, and is formed in an annular shape, as a whole. The inner diameter of the electromagnetic coil 8 is larger than the outer diameter of the container 9. In other words, a gap is formed between the inner surface of the electromagnetic coil 8 and the external surface of the container 9. Moreover, the total length in the axial center direction of the electromagnetic coil 8 is considerably shorter than the total length in the axial center direction of the container 9. It is preferable that the total length in the axial center direction of the electromagnetic coil 8 be not more than two third of the total length in the axial center direction of the container 9. In the illustrated example, the inner diameter of the electromagnetic coil 8 is 90 mm, and the total length in the axial center direction of the electromagnetic coil 8 is 85 mm.

The outer cover 46 is mounted on the aforementioned electromagnetic coil holding base 18 so that the axial center of the outer cover 46, i.e., the axial center of the electromagnetic coil 8, itself, is parallel to the arrow X. The electromagnetic coil 8 is disposed coaxially with the hollow holding member 32, the chuck shaft 39 and the container 9. The plurality of coil units 47 are arranged in parallel to each other along a circumferential direction of the outer cover 46, i.e., the electromagnetic coil 8. Currents are applied to the coil units 47 by a three-phase alternating-current source 48 shown in FIG. 9. Currents with different phases are applied to the plurality of coil units 47, and thereby the plurality of coil units 47 generate magnetic fields with different phases. Then, by combining these magnetic fields with different phases, the electromagnetic coil 8 generates, thereinside, a magnetic field (rotating magnetic field) having a rotating direction about the axial center of the electromagnetic coil 8.

The foregoing electromagnetic coil 8 receives the currents from the three-phase alternating-current source 48, and generates the rotating magnetic field. Concurrently, the electromagnetic coil 8 is moved by the electromagnetic coil moving unit 5 along a longitudinal direction of the axial center, i.e., the container 9. Then, by using the aforementioned rotating magnetic field, the electromagnetic coil 8 positions magnetic abrasive grains 65, to be described later, on the outer circumference of the process target object 2, and causes the magnetic abrasive grains 65 to rotate (move) about the axial center of the container 9 and the process target object 2. After that, by using the aforementioned rotating magnetic field, the electromagnetic coil 8 causes the magnetic abrasive grains 65 to collide with the external surface of the process target object 2.

In addition, an inverter 49 is provided between the three-phase alternating-current source 48 and the electromagnetic coil 8. In other words, the surface processing apparatus 1 includes the inverter 49. The inverter 49 is capable of changing the frequency, the current value and the voltage value of power applied to the electromagnetic coil 8 by the three-phase alternating-current source 48. By changing the frequency, the current value and the voltage value of power applied to the electromagnetic coil 8, the inverter 49 increases or decreases the power applied to the electromagnetic coil 8 by the three-phase alternating-current source 48, and thereby changes the intensity of the rotating magnetic field generated by the electromagnetic coil 8.

As shown in FIG. 9, the container 9 includes a cylindrical member 50 having an external wall of a single structure (the external wall formed of a single wall), a plurality of flange members 51, a pair of shaving sealing holders 52, a pair of shaving sealing plates 53, a pair of positioning members 54 and a plurality of partitioning members 55 as a partitioning device.

The cylindrical member 50 is formed in a cylindrical shape, and forms an outer cover of the container 9. Since the cylindrical member 50 is formed in the single structure, the external wall of the container 9 is formed in the single structure, and in the cylindrical shape. The outer diameter of the cylindrical member 50, i.e., the container 9 is preferably on the order of 40 mm to 80 mm. Moreover, the thickness of the cylindrical member 50 is preferably on the order of 0.5 mm to 2.0 mm. The length in the axial center direction of the cylindrical member is on the order of 600 mm to 800 mm. The cylindrical member 50 is composed of a non-magnetic material.

The cylindrical member 50 is provided with a plurality of abrasive grain supply holes 57. Of course, each abrasive grain supply hole 57 passes through the cylindrical member 50, and allows the outside and inside of the cylindrical member 50 to communicate with each other. A sealing cap 58 is attached to each of the abrasive grain supply holes 57. Through the abrasive grain supply holes 57, the magnetic abrasive grains 65 are taken in and out of the cylindrical member 50, that is, the container 9. On the other hand, the sealing caps 58 prevent the magnetic abrasive grains 6 from getting out of the cylindrical member 50, that is, the container 9 by sealing the abrasive grain supply holes 57.

The plurality of flange members 51 are each formed in an annular shape or a columnar shape. A majority, i.e., all except one, of the plurality of flange members 51 (three in the illustrated example) are attached to the first end portion 9*a* of the cylindrical member 50, and the one flange member 51 (expressed below with reference numeral 51*a*) is attached to the second end portion 9*b* of the cylindrical member 50.

One of the flange members 51 (expressed below with reference numeral 51*b*) attached to the first end portion 9*a* of the cylindrical member 50 is formed in an annular shape, and is fitted to the outer circumference of the cylindrical member 50. Another one of the flange members 51 (expressed below with reference numeral 51*c*) is formed in an annular shape, and is fitted to the outer circumference of the foregoing flange member 51*b*. The remaining flange member 51 (expressed below with reference numeral 51*d*) integrally includes a ring portion 59 with an annular shape and a columnar portion 60 with a column shape. The ring portion 59 is provided so as to protrude from an outer edge of the columnar portion 60. The ring portion 59 of the flange member 51*d* is fitted to the outer circumference of the flange member 51*c*.

The foregoing flange member 51*d* rotatably supports a follower shaft 73 with bearings 74. The follower shaft 73 is formed in a columnar shape, and is disposed coaxially with the cylindrical member 50 of the container 9. An end surface of the follower shaft 73 is pressed against the hollow holding member 32. The follower shaft 73 rotates together with the hollow holding member 32, and supports the first end portion 32*a* of the hollow holding member 32, which is a free end.

The foregoing flange member 51*a* is formed in an annular shape, and is fitted to the outer circumference of the second end portion 9*b* of the cylindrical member 50. The hollow holding member 32 passes through the inner side of the flange member 51*a*. Note that the first end portion 9*a* and the second end portion 9*b* of the cylindrical member 50 also form a first end portion and a second end portion of the container 9, respectively.

The pair of shaving sealing holders 52 are each formed in an annular shape. A first one of the shaving sealing holders 52 is fitted to an inner circumference of the first end portion 9*a* of the cylindrical member 50, and the other second shaving sealing holder 52 is fitted to an inner circumference of the second end portion 9*b* of the cylindrical member 50. The hollow holding member 32 passes through the inner side of the second shaving sealing holder 52.

The pair of shaving sealing plates 53 are each formed in a mesh shape. A first one of the shaving sealing plates 53 is formed in a disc-like shape, is arranged at the inner circumference of the first end portion 9*a* of the cylindrical member 50, and is also attached to the above-mentioned first sealing holder 52. In addition, the follower shaft 73 passes through the inner side of the first shaving sealing plate 53. The other second shaving sealing plate 53 is formed in an annular shape, is arranged at the inner circumference of the second end portion 9*b* of the cylindrical member 50, and is also attached to the above-mentioned second shaving sealing holder 52. The hollow holding member 32 passes through the inner side of the second shaving sealing plate 53. The shaving sealing plates 53 prevents shavings from getting out of the cylindrical member 50, i.e., the container 9, when the shavings are formed by shaving the process target object 2 due to collision of the magnetic abrasive grains 65, to be described later, with the external surface of the process target object 2.

The pair of positioning members 54 are each formed in a columnar shape. A first one of the positioning members 54 is fitted to the outer circumference of the first end portion 32*a*, which is the free end of the hollow holding member 32. The other second positioning member 54 is fitted to the outer circumference of a central portion 32*b* of the hollow holding member 32. The central portion 32*b* is located inside the cylindrical member 50, and near the second end portion 9*b*. The pair of positioning members 54 position the process target object 2 on the hollow holding member 32 with the process target object 2 sandwiched therebetween. Note that the first end portion 32*a* forms the end portion of the hollow holding member 32 that is close to the fixed holding unit 4 and far from the movable holding unit 6. The central portion 32*b* forms the end portion of the hollow holding member 32 that is far from the fixed holding unit 4 and close to the movable holding unit 6 inside the container 9.

The partitioning members 55 each have a main body 61 formed in an annular shape, and a mesh portion 62. The main bodies 61, i.e., the partitioning members 55 are fitted into the inner circumference of the cylindrical member 50, and thereby are attached to the cylindrical member 50. In addition, the hollow holding member 32 passes through the inner sides of the partitioning members 55. The plurality of main bodies 61, i.e., partitioning members 55 are disposed between the pair of shaving sealing plates 53. Moreover, the plurality of main bodies 61, i.e., partitioning members 55 are arranged side by side at intervals along the axial center P, i.e., the longitudinal direction of the cylindrical member 50. In the illustrated example, seven partitioning members 55 are provided.

The main body 61 is provided with a through hole 63. The mesh portion 62 is attached to the main body 61 so as to fill the through hole 63. Since the mesh portion 62 is formed in the mesh shape, the mesh portion 62 allows gas and shavings to pass therethrough, and prevents the magnetic abrasive grains 65 from passing therethrough.

The foregoing plurality of partitioning members 55 partition the space inside the cylindrical member 50, i.e., the container 9 along the axial center of the cylindrical member 50, i.e., the container 9, that is, the axial center P of the process target object 2. In addition, the axial center P forms both the axial center of the container 9 and the axial center of the hollow holding member 32, and also forms the longitudinal direction of the container 9. In other words, the axial center P and the longitudinal direction of the container 9 are parallel to each other. Moreover, both the foregoing main bodies 61 and the mesh portions 62, i.e., the partitioning members 55 are composed of a non-magnetic material.

The container 9 having the foregoing structure houses the abrasive grains 65 made of a magnetic material (hereinafter, referred to as the magnetic abrasive grains) in the spaces between the plurality of partitioning members 55, and houses the process target object 2 attached to the hollow holding member 32 in the cylindrical member 50. In short, the container 9 houses both the process target object 2 and the magnetic abrasive grains 65. Moreover, the magnetic abrasive grains 65 collide with the external surface of the process target object 2 while rotating (moving) or the like around the outer circumference of the process target object 2 due to the aforementioned rotating magnetic field. Each magnetic abrasive grain 65 as a line-shaped grain collides with the external surface of the process target object 2, shaves a part of the process target object 2 from the external surface, and thereby roughens the external surface of the process target object 2. Note that, in the illustrated example, the magnetic abrasive grain 65 is formed in a columnar shape, and has an outer diameter on the order of 0.5 mm to 1.4 mm, and a total length on the order of 3.0 mm to 14.0 mm.

The magnetic abrasive grain 65 is composed of a magnetic material such as an austenitic stainless steel or a martensitic stainless steel, for example. As shown in FIG. 10, the magnetic abrasive grain 65 is formed in a columnar shape like a tow. The magnetic abrasive grain 65 is formed to have the outer diameter of 0.5 mm to 1.2 mm inclusive. When L denotes the total length and D denotes the outer diameter, the magnetic abrasive grain 65 is formed so that L/D is from 4 to 10 inclusive.

Moreover, as shown in FIGS. 10 and 11, outer edge portions 65*a* at both ends of the magnetic abrasive grain 65 are chamfered around the entire perimeter, and are each formed to have a cross section of a circular arc shape. The outer edge portion 65*a* is formed to have a curvature radius r of 0.05 mm to 0.2 mm inclusive.

As shown in FIG. 12, due to the aforementioned rotating magnetic field, the above magnetic abrasive grain 65 revolves in a circumferential direction of the foregoing container 9 and developing sleeve 132 (orbital revolution), while rotating on its own center in the longitudinal direction (spinning).

As shown in FIG. 9, the collection unit 10 includes gas inflow pipes 66, gas discharge holes 67, mesh members 68, a gas discharge duct 69 and a dust collector 70 (shown in FIG. 8). The gas inflow pipes 66 are provided closer to the edge (at the side of the movable holding unit 6) of the cylindrical member 50, i.e., the container 9 than the second shaving sealing holder 52 is, and have openings inside the cylindrical member 50, i.e., the container 9. To the gas inflow pipes 66, pressurized gas or the like is supplied from an unillustrated pressurized gas supply source. The gas inflow pipe 66 introduces the pressurized gas to the inside of the cylindrical member 50, i.e., the container 9.

The gas discharge hole 67 passes through the cylindrical member 50, and thereby allows the inside and outside of the container 9 to communicate with each other. The gas discharge hole 67 is provided farther from the edge (at the side far from movable holding unit 6) of the cylindrical member 50, i.e., the container 9 than the first shaving sealing holder 52 is. The mesh members 68 are attached to the cylindrical member 50 so as to fill the gas discharge holes 67. The mesh members 68 allow shavings and gas to pass therethrough, and prevent the magnetic abrasive grains 65 from passing therethrough. In other words, the mesh members 68 prevents the magnetic abrasive grains 65 from getting out of the cylindrical member 50, i.e., the container 9.

The gas discharge duct 69 is piping, and is attached to a place near the gas discharge holes 67. The gas discharge duct 69 surrounds the outer edges of the gas discharge holes 67. The gas discharge holes 67 and the gas discharge duct 69 introduce the gas, which is supplied from the gas inflow pipes 66 to the cylindrical member 50, i.e., the container 9, to the outside of the cylindrical member 50, i.e., the container 9.

The dust collector 70 is connected to the gas discharge duct 69, and sucks the gas inside the gas discharge duct 69. The dust collector 70 sucks the gas and the aforementioned shavings in the cylindrical member 50, i.e., the container 9, by sucking the gas inside the gas discharge duct 69. The dust collector 70 collects the shavings. The above-mentioned collection unit 10 supplies gas to the cylindrical member 50, i.e., the container 9 through the gas inflow pipes 66, and guides the shavings to the outside of the cylindrical member 50, i.e., the container 9 through the gas discharge holes 67 and the gas discharge duct 69 by using the gas and the dust collector 70. Then, the collection unit 10 collects the shavings in the dust collector 70.

As shown in FIG. 8, the cooling unit 11 includes cooling fans 71 and cooling ducts 72. The cooling fan 71 supplies pressurized gas to the cooling duct 72. The cooling duct 72 is piping. The cooling duct 72 guides the pressurized gas supplied from the cooling fan 71 to the electromagnetic coil 8. The cooling duct 72 blows the pressurized gas supplied from the cooling fan 71 to the electromagnetic coil 8. The cooling unit 11 cools the electromagnetic coil 8 by blowing the pressurized gas to the electromagnetic coil 8.

As shown in FIG. 9, the linear encoder 75 includes a main body and a sensor 78 movably provided to the main body 77. The main body 77 extends in a line, and is attached to the base 3. The main body 77 is disposed in parallel to the rails 20 between the pair of rails 20. The total length of the main body 77 is longer than that of the foregoing container 9. The main body 77 is disposed in a position where both end portions in the longitudinal direction of the main body 77 protrude outwardly from the container 9 along the longitudinal direction of the container 9.

The sensor 78 is provided to be movable along the longitudinal directions of the main body 77, i.e., the container 9. The sensor 78 is attached to the electromagnetic coil holding base 18. Precisely, the sensor 78 is attached to the electromagnetic coil 8 with the electromagnetic coil holding base 18 interposed in between.

The above linear encoder 75 detects the position of the sensor 78 relative to the main body 77, i.e., the container 9, and outputs the detection result to the controlling device 76. In this way, the linear encoder 75 detects the position of the electromagnetic coil 8 relative to the container 9, i.e., the process target object 2, and outputs the detection result to the controlling device 76.

The controlling device 76 is a computer including a known RAM, ROM, CPU and the like. The controlling device 76 is connected to the electromagnetic coil moving unit 5, the movable holding unit 6, the movable chuck unit 7, the electromagnetic coil 8, the inverter 49, the collection unit 10, the cooling unit 11, the linear encoder 75, the reflection-type displacement gauge 80 and the like, and controls the entire surface processing apparatus 1 by controlling these units.

The controlling device 76 stores an intensity of the rotating magnetic field of the electromagnetic coil 8 corresponding to each position of the electromagnetic coil 8 relative to the process target object 2, which is to be detected by the linear encoder 75. In other words, the controlling device 76 stores an information piece on the power, which is adjusted by the inverter 49 and applied to the electromagnetic coil 8, corresponding to each position of the electromagnetic coil 8 relative to the process target object 2. In addition, the controlling device 76 stores an information piece on the power for each product number of process target objects 2, i.e., developing sleeves 132.

In the illustrated example, the controlling device 76 previously stores a pattern in which the inverter 49 gradually increases the power applied to the electromagnetic coil 8 as the electromagnetic coil 8 moves from the central portion in the longitudinal direction (axial direction) to both end portions thereof. Then, the controlling device 76 causes the inverter 49 to change the intensity of the rotating magnetic field generated by the electromagnetic coil 8 in accordance with the previously-stored pattern of the power. In this way, in the case of the illustrated example, the controlling device 76 causes the inverter 49 to change the intensity of the rotating magnetic field generated by the electromagnetic coil 8 so that the intensity of the rotating magnetic field at a time of processing both end portions of the process target object 2 would be stronger than that at a time of processing the central portion of the process target object 2. As described above, the controlling device 76 causes the inverter 49 to change the intensity of the rotating magnetic field generated by the electromagnetic coil 8, according to the position of the electromagnetic coil 8 relative to the container 9, i.e., the process target object 2 which is detected by the linear encoder 75.

Moreover, the controlling device 76 performs a fast Fourier transform (FFT) as a frequency analysis of a profile curve that is a result of a measurement of asperities of the external surface of the process target object 2 after the roughening process. Furthermore, out of a spectrum indicating the intensities of wavelength components, and obtained by resolving, by wavelength, the asperities of the profile curve that is computed by applying the FFT, a certain wavelength component and its intensity are set in advance in the controlling device 76, and these are used as criteria to judge whether or not the process target object 2 is a defective item.

Moreover, to the controlling device 76, various types of input devices such as a key board and of display devices such as a display are connected.

The reflection-type displacement gauge 80 is a reflection-type of noncontact laser measuring device, and measures the asperities on the external surface of the process target object 2 by using an optical device after the external surface is roughened by the roughening process. The reflection-type displacement gauge 80 is positioned at a certain measurement place to which the process target object 2 is slid and moved out of the container 9 after the external surface is roughened by the roughening process.

Hereinafter, descriptions will be given for a process of manufacturing the developing sleeve 132 by processing (roughening) the external surface of the process target object 2 with the surface processing apparatus 1 having the foregoing structure.

Firstly, a product number and the like of the process target object 2, i.e., the developing sleeve 132 are inputted to the controlling device 76 from an input device. Then, columnar caps 64 are fitted to the outer circumference at both ends in the longitudinal direction (axial direction) of the process target object 2. Then, the aforementioned second positioning member 54 is fitted to the outer circumference of the hollow holding member 32. Next, the hollow holding member 32 is placed inside the process target object 2 having the caps 64 attached to both ends thereof. After that, the aforementioned first positioning member 54 is fitted to the outer circumference of the hollow holding member 32. Then, the process target object 2 is fixed to the hollow holding member 32 by shrinking the chuck shaft 39 of the chuck cylinder 34. At this time, the hollow holding member 32, the process target object 2 and the like are made coaxial. In this way, the process target object 2 is attached to the hollow holding member 32.

Then, the process target object 2 and the hollow holding member 32 are housed in the container 9 that is a processing place, and the magnetic abrasive grains 65 are supplied to the cylindrical member 50 of the container 9. In this way, the magnetic abrasive grains 65 and the process target object 2 are housed in the container 9. In addition, the container 9 is chucked with the holding chucks 28 and 43. Thus, the process target object 2 and the container 9 are attached to the movable holding unit 6. Consequently, the cylindrical member 50 of the container 9, the hollow holding member 32, the process target object 2 and the like are made coaxial.

These attachment operations are, of course, conducted while adjusting the position of the moving base 26 by the use of the actuators 24 and 25. Moreover, these operations are, of course, conducted while adjusting the position of the holding base 41. The fixed holding unit 4 is caused to hold the first end portion 9*a* of the container 9 in a way that the first end portion 9*a* of the container 9 is chucked by the holding chuck 16 and in an equivalent way.

Next, the cooling unit 11 is caused to blow pressurized gas to the electromagnetic coil 8 while gas is supplied to the inside of the container 9 through the gas inflow pipes 66 of the collection unit 10, and while the gas in the container 9 is sucked by the dust collector 70.

Then, the drive motor 33 is caused to rotate the process target object 2 together with the hollow holding member 32 about the axial center P. Thereafter, by applying the power to the electromagnetic coil 8 from the three-phase alternating-current source 48, the electromagnetic coil 8 is caused to generate a rotating magnetic field. As a result, the magnetic abrasive grains 65 located at the inner side of the electromagnetic coil 8 revolve (revolving, i.e., moving) about the axial center P while spinning. Thereby, the magnetic abrasive grains 65 collide with the external surface of the process target object 2, and roughen the external surface of the process target object 2.

Then, the electromagnetic coil moving unit 5 moves the electromagnetic coil 8 along the axial center P as needed. As a result, the magnetic abrasive grains 65 newly entering the inner side of the electromagnetic coil 8 start moving (spin and revolve) due to the foregoing rotating magnetic field, while the magnetic abrasive grains 65 getting out of the inner side of the electromagnetic coil 8 stop moving. Moreover, since the partitioning members 55 partitions the space inside the container 9, the magnetic abrasive grains 65 are prohibited from moving beyond the partitioning members 55, and thereby the magnetic abrasive grains 65 getting out of the inner side of the electromagnetic coil 8 also get out of the aforementioned rotating magnetic field. Then, the roughening of the external surface of the process target object 2 is completed after the electromagnetic coil moving unit 5 reciprocates the electromagnetic coil 8 along the arrow X a predetermined number of times.

In addition, the intensity of the rotating magnetic field generated by the electromagnetic coil 8 increases as the electromagnetic coil 8 moves from the central portion of the process target object 2 to both ends thereof. The stronger the rotating magnetic field is, the harder the magnetic abrasive grains 65 moves. Accordingly, as the intensity of the rotating magnetic field increases, the magnetic abrasive grains 65 vigorously collide with the process target object 2, and the roughness of the external surface of the process target object 2 is made increased.

When the foregoing roughening process on the external surface of the process target object 2 is completed, the power application to the electromagnetic coil 8 and the drive motor 33 are stopped. Moreover, the collection unit 10 and the cooling units 11 are also stopped. The holding chuck 28 of the movable holding unit 6 is caused to release the hold of the container 9. While the holding chuck 16 of the fixed holding unit 4 and the holding chuck 43 of the movable chuck unit 7 keep holding the container 9, the moving base 26 is slid and moved along the arrow X in a direction away from the second end portion 9*b* of the container 9 by using the first actuator 24. Consequently, the process target object 2 is taken out from the container 9 while being held by the hollow holding member 32.

Thereafter, the moving base 26 is slid and moved to the predetermined measurement place outside the container 9 of the process target object 2, and then is stopped. After that, the drive motor 33 of the movable holding unit 6 is rotated, and thereby the process target object 2 is rotated together with the hollow holding member 32 about the axial center P. The reflection-type displacement gauge 80 is moved to a position where the asperities on the external surface of the process target object 2 can be measured, and thereby measures the asperities during its one rotation in a circumferential direction.

The asperities on the external surface of the process target object 2 measured by the reflection-type displacement gauge 80 are sent to the controlling device 76. When the asperities on the external surface of the process target object 2 measured during one rotation in a circumferential direction are sent, the controlling device 76 performs an FFT that is a frequency analysis of a profile curve indicated by the asperities. FIG. 14 shows an example of the profile curve, and FIG. 15 shows an example of a spectrum obtained by performing the FFT (hereinafter, such a spectrum is simply called an FFT spectrum). The horizontal axis in FIG. 14 indicates the distance in the circumferential direction of the process target object 2. The vertical axis in FIG. 14 indicates the depth of the surface of the cross section of the process target object 2. The horizontal axis in FIG. 15 indicates the wavelengths of the profile curve of the external surface, that is, the wavelengths of the asperities formed on the external surface. The vertical axis in FIG. 15 indicates the absolute value of the amplitude of each wavelength of the profile curve of the external surface.

Then, the controlling device 76 judges whether or not the peak of a part of the obtained FFT spectrum within a range of wavelengths not more than 1 mm is not more than 12, and thereby judges whether or not the process target object 2 is a defective item. In the case of FIG. 15, since the intensity of the peak is approximately 7.8, the process target object 2 is judged as a non-defective item.

When judged as the non-defective item, the process target object 2 is recognized as the non-defective item, and is removed from the hollow holding member 32. Then, a new process target object 2 is attached and processed.

In this way, the external surface of a developing sleeve 132 is roughened, the profile curve is obtained after the roughening process is completed, an FFT is performed, and then the result of the FFT is used to judge whether or not the developing sleeve 132 is a defective item. Thereby, by performing an FFT using the profile curve of the external surface of a developing sleeve 132, it is possible to obtain a developing sleeve 132 (shown in FIG. 4) whose FFT spectrum within a range of wavelengths not more than 1 mm has the peak not more than 12, and whose external surface has the roughness gradually increasing from the central portion to both ends thereof.

According to this embodiment, a large number of substantial oval depressions provided randomly on the external surface of the developing sleeve 132 have the peak intensity of an FFT spectrum, within a range of wavelengths not more than 1 mm, that is not more than 12. The FFT spectrum is obtained by using the profile curve as a result of a measurement of the external surface with the reflection-type displacement gauge 80. Use of the developing sleeves 132 having the above characteristics gives developer only small stress, and thereby suppresses deterioration of the developer. Accordingly, the pick-up amount of the developer is kept stable over a long time, which allows the developer to form high quality images free from density unevenness over a long time. Moreover, by employing a developing sleeve 132 having the peak intensity of the FFT spectrum, obtained by using the above profile curve, within a range of wavelengths not more than 1 mm that is not more than 10, the stress imposed on the developer can be more reduced, so that higher quality images free from density unevenness can be formed over a long time.

The substantial oval depressions 139, each of which is far greater than a depression formed by a conventional sandblast process, are formed on the external surface of the developing sleeve 132 (the major axis is from 0.05 mm to 0.3 mm inclusive, and the minor axis is from 0.02 mm to 0.1 mm inclusive). Accordingly, the depression 139 is less likely to be worn even with a change over time. This makes it possible to suppress a decrease of the pick-up amount of the developer due to a change over time.

In the developing sleeve 132, the oval depressions 139 formed on the external surface are arranged randomly. Since the developer is picked up by the depressions 139, the locations that pick up the developer are arranged randomly on the external surface. This prevents images from having unevenness.

In addition, the number of the depressions 139 each having its longitudinal direction along the axial direction of the developing sleeve 132 is larger than that of the depressions 139 each having its longitudinal direction along the circumferential direction of the developing sleeve 132. As a result, the developer particles picked up by the depressions 139 are lined up along the axial direction of the developing sleeve 132. Accordingly, even when the developing sleeve 132 rotates, the picked-up developer particles are less likely to fall from the external surface of the developing sleeve. In this way, the oval depressions 139 can produce an effect similar to that of a V-groove, which has been used heretofore, and can ensure a sufficient pick-up amount of the developer.

Moreover, since the oval depressions 139 are formed by causing the magnetic abrasive grains 65 to collide with the external surface randomly, it is possible to prevent the developing sleeve 132 from having the axial center bent, the inner and outer diameters changed, and/or the cross section made in an oval shape. In other words, a high runout accuracy of the developing sleeve 132 can be achieved.

Further, the asperities are formed randomly on the developing sleeve 132. Such asperities prevent the amount of developer supplied to the photosensitive drum 108 from being uneven, and thereby prevent formed images from having density unevenness.

By causing the magnetic abrasive grains 65 located inside the rotating magnetic field to collide with the external surface of the developing sleeve 132, the magnetic abrasive grains 65 more randomly collide with the external surface of the developing sleeve 132. As a result, it is possible to easily obtain the characteristic that the peak intensity of an FFT spectrum within a range of wavelengths not more than 1 mm is not more than 10. In other words, more uniform asperities can be formed on the external surface of the developing sleeve, and thereby more uniform images can be obtained than otherwise.

In addition, the asperities can be formed on the external surface of the developing sleeve 132 by locating the magnetic abrasive grains 65 inside the rotating magnetic field, which avoids an increase in processing necessary for forming the asperities on the external surface of the developing sleeve 132. As a result, it is possible to prevent the processing for forming the asperities on the external surface of the developing sleeve 132 from being complicated, and accordingly to prevent costs needed for the processing from increasing.

Moreover, the asperities can be formed on the external surface of the developing sleeve 132 by locating the magnetic abrasive grains 65 inside the rotating magnetic field. During the asperity formation, each of the magnetic abrasive grains 65 rotates on its own central portion in the longitudinal direction, and revolves around the outer circumference of the developing sleeve 132 along a radial direction of the rotating magnetic field. For this reason, the outer edge portions 65*a* of both ends in the longitudinal direction of the magnetic abrasive grain 65 collide with the developing sleeve 132, and thereby many of the asperities, especially the depressions 139, formed on the external surface of the developing sleeve 132 are along the axial (longitudinal) direction of the developing sleeve 132. As a result, the depressions 139 formed on the external surface of the developing sleeve 132 can surely produce an effect similar to that of a V-groove, which has been used heretofore, and can ensure a sufficient pick-up amount of the developer.

Furthermore, random collisions of the magnetic abrasive grains 65 with the external surface of the developing sleeve 132 due to the rotating magnetic field make random the asperities formed on the external surface of the developing sleeve 132 more surely. Accordingly, it is possible to prevent images formed by the developing sleeve 132 from having unevenness.

Housing the developing sleeve 132 together with the magnetic abrasive grains 65 in the container 9 surely causes the magnetic abrasive grains 65 to collide with the external surface of the developing sleeve 132. As a result, the roughening process can be surely performed on the external surface of the developing sleeve 132.

Since the magnetic abrasive grains 65 collide with the rotating developing sleeve 132 in the container 9, the magnetic abrasive grains 65 even more randomly collide with the external surface of the developing sleeve 132. This makes it possible to form more uniform depressions 139 with higher accuracy than otherwise, and thereby to obtain images with little unevenness.

According to the above image forming apparatus 101, since the average grain size of the magnetic carriers 135 in the developer is from 20 μm to 50 μm inclusive, use of this developer makes it possible to obtain a high quality image with excellent granularity and little unevenness. It is not preferable that the average grain size of the magnetic carriers 135 be less than 20 μm. This is because, if so, the small magnetization of each magnetic carrier 135 makes the magnetic binding force of the magnetic carrier 135 to the developing roller 115 so weak that the magnetic carrier 135 is more likely to be attracted to the photosensitive drum 108. In contrast, it is also not preferable that the average grain size of the magnetic carriers 135 be more than 50 μm. This is because, if so, the electric field between the magnetic carriers 135 and the electrostatic latent image on the photosensitive drum 108 becomes so spares that a uniform image cannot be obtained (image quality is degraded).

Moreover, it is possible to provide the process cartridges 106Y, 106M, 106C and 106K and the image forming apparatus 101 that can form and offer high quality images over a long time because they include the aforementioned development devices 113.

In addition, since the gap between the developing sleeve 132 and the photosensitive drum 108 is from 0.1 mm to 0.4 mm inclusive, the toner can be surely supplied to the photosensitive drum 108 from the developer that forms chains on the developing sleeve 132, and high quality images can be accordingly obtained. It is not preferable that the gap between the developing sleeve 132 and the photosensitive drum 108 be less than 0.1 mm. This is because, if so, the electric field between the developing sleeve 132 and the photosensitive drum 108 becomes so strong that the magnetic carriers 135 are attracted to the photosensitive drum 108. In contrast, it is also not preferable that the gap between the developing sleeve 132 and the photosensitive drum 108 is more than 0.4 mm for the following reasons. If so, the electric field between the developing sleeve 132 and the photosensitive drum 108 becomes so weak that an amount of toner that can be supplied to the photosensitive drum 108 decreases. As a result, the development efficiency decreases, and too large edge effects of the electric field at edges in an image do not allow a uniform image to be obtained In this embodiment, used is the developer including the magnetic carriers 135 each formed by coating the surface of the core member 136 with the resin coating film 137 made of the mixture of the charging control agent and the resin ingredient obtained by making cross-links between the thermoplastic resin and the melamine resin. As such, the magnetic carrier 135 obtained by coating the core member 136 with the elastic resin coating film 137 is used. Since the resin coating film 137 is elastic, it absorbs impacts on the magnetic carrier 135, and prevents the magnetic carrier 135 from being worn. Accordingly, the magnetic carrier 135 can have a longer lifetime than conventional magnetic carriers.

Moreover, the alumina particles 138 being larger than the thickness of the resin coating film 137 are shattered on the foregoing resin coating film 137. In this embodiment, used is the developer containing the magnetic carrier 135 provided with the alumina particles 138 protruding from the external surface of the resin coating film 137. Thereby, the alumina particles 138 can block collision with the resin coating film 137, and can clean spent substances.

As a result, it is possible to prevent the resin coating film 137 from being worn and spent, and accordingly to make the lifetime of the magnetic carrier 135 longer than that of the conventional magnetic carriers. This results in an achievement of stabilization of the pick-up amount of toner, i.e., formation of high quality images, over a long time.

Since the toner obtained by using the emulsion polymerization method or the suspension polymerization is selected, the toner has such excellent sphericity that an effect of visually improving density unevenness remaining in an image is produced.

Since the outer diameter D of the magnetic abrasive grain 65 is from 0.5 mm to 1.2 mm inclusive, the asperities formed on the external surface of the developing sleeve 132, which is the process target object, are less likely to be worn with a change over time. Consequently, the developing sleeve 132 can prevent a decrease of the pick-up amount of developer, otherwise the decrease would occur with a change over time. This suppresses a change over time, and prevents images from being made light.

As described above, it is possible to provide the magnetic abrasive grain 65 and the surface processing apparatus 1 which are capable of performing the roughening process on the external surface of the developing sleeve 132 so as to reduce the decrease of the pick-up amount of developer of the developing sleeve 132 with a change over time, and to prevent images from having unevenness.

Moreover, the ratio (L/D) of the total length L to the outer diameter D is from 4 to 12 inclusive. For this reason, the outer edge portions 65*a* of both ends in the longitudinal direction of the magnetic abrasive grain 65 surely collide with the developing sleeve 132. In addition, the total length of the magnetic abrasive grain 65 is made long enough to form an asperity having a sufficient depth (largeness) on the external surface of the developing sleeve 132. Accordingly, it is possible to form the asperities surely, and to secure a sufficient pick-up amount of developer of the developing sleeve 132.

Further, the outer edge portions 65*a* at both ends of the magnetic abrasive grain 65 are chamfered and formed each with the cross section of the circular arc shape. Accordingly, smooth asperities can be formed on the external surface of the developing sleeve 132, which is the process target object, and this prevents the developer for the developing sleeve 132, i.e., the magnetic carriers 135 and the like from changing over time.

Since the curvature radius r of each of the outer edge portions 65*a* formed on both edges in the longitudinal direction of the magnetic abrasive grain 65 is 0.05 mm to 0.2 mm inclusive, smooth asperities can be formed on the external surface of the developing sleeve 132, which is the process target object.

Since the magnetic abrasive grain 65 is composed of a magnetic material such as an austenitic stainless steel or a martensitic stainless steel, the magnetic abrasive grain 65 can be easily obtained, and the costs for producing the magnetic abrasive grains 65 can be reduced.

The controlling device 76 can change the intensity of the rotating magnetic field generated by the electromagnetic coil 8 according to the position of the electromagnetic coil 8 relative to the container 9, i.e., the developing sleeve 132. When the rotating magnetic field becomes stronger, the magnetic abrasive grains 65 more actively move, the energy of movement of the magnetic abrasive grain 65 when colliding with the external surface of the developing sleeve 132 becomes higher, and consequently, the roughness of the external surface of the developing sleeve 132 is increased.

With this effect, the roughness of the external surface at any arbitrary part in the longitudinal direction in the axial direction of the developing sleeve 132 can be changed as desired. Hence, when the developing sleeve 132 is used as a developing sleeve, it is possible to increase the pick-up amount at a certain part of the developing sleeve 132 as well as to decrease the pick-up amount at a certain part of the developing sleeve 132. Accordingly, by making rougher the external surface of a part of the developing sleeve 132 picking up a small amount of developer, the pick-up amount of the part picking up the small amount can be increased. In this way, images formed by the image forming apparatus 101 including the developing sleeve 132 can be prevented from having unevenness. Thus, the external surface of the developing sleeve 132 can be roughened by the roughening process so that unevenness in images would be prevented.

Since the controlling device 76 changes the intensity of the rotating magnetic field in accordance with the predetermined pattern, the external surface of the developing sleeve 132 can be constantly processed in a fixed pattern by the roughening process.

Since the controlling device 76 sets greater the intensity of the rotating magnetic field at a time of processing both end portions of the developing sleeve 132 than that at a time of processing the central portion thereof, the external surfaces of both end portions of the developing sleeve 132 that pick up small amounts can be made rougher than that of the central portion that picks up a large amount. By making the external surfaces of both end portions of the developing sleeve 132 that pick up the small amounts rougher, the pick-up amounts of the two end portions can be increased, and accordingly, images formed by the image forming apparatus 101 including the developing sleeve 132 can be surely prevented from having unevenness. Thus, the external surface of the developing sleeve 132 can be surely roughened by the roughening process so that unevenness in images would be prevented.

With a movement of the electromagnetic coil 8, the developing sleeve 132 is processed, and concurrently the magnetic abrasive grains 65 quickly get out of the rotating magnetic field. As a result, the intensity of the magnetic field affecting the magnetic abrasive grains 65 quickly changes (decreases). This change misaligns the magnetic abrasive grains 65 that have been aligned in the magnetic domain, and thereby the magnetization is weakened. Thus, the movement of the electromagnetic coil 8 produces effects of processing the developing sleeve 132 and of removing the remaining magnetization of the magnetic abrasive grains 65, simultaneously.

As described above, this configuration does not need another device for removing the remaining magnetization of the magnetic abrasive grains 65 in addition to the surface processing apparatus 1. Accordingly, the magnetic abrasive grain 65 can be easily demagnetized, and continuous processing can be performed on developing sleeves 132 for a long time, so that the processing efficiency in the surface process can be enhanced. Thus, it is possible to obtain a surface processing apparatus 1 as a mass production apparatus based on high-volume manufacturing of developing sleeves 132.

Holding the developing sleeve 132 in the center of the container 9 causes the magnetic abrasive grains 65 to collide with the external surface of the developing sleeve 132 substantially uniformly. Consequently, the external surface of the developing sleeve 132 can be processed uniformly.

Since the magnetic abrasive grains 65 move (revolve) around the outer circumference of the developing sleeve 132, the magnetic abrasive grains 65 are surely caused to collide with the external surface of a process target object, and therefore the developing sleeve 132 can be surely processed.

By rotating the developing sleeve 132, the magnetic abrasive grains 65 are caused to collide with the external surface of the developing sleeve 132 uniformly, and thereby the external surface of the developing sleeve 132 can be more uniformly processed.

Employing the electromagnetic coil 8 whose total length is shorter than the container 9 allows a strong rotating magnetic field to be generated, and a loss of the rotating magnetic field generated in the container 9 to be reduced, as compared with a case of employing a surface processing device including an electromagnetic coil 8 whose total length is substantially equal to that of container 9. As a result, the efficiency in processing on the developing sleeve 132 can be enhanced and power consumption also can be saved.

Moreover, since the electromagnetic coil 8 is shorter than the container 9, both ends of the container 9 can be held. This holding prevents the container 9 from oscillating (moving) with movements of the magnetic abrasive grains 65 and the like. As a result, it is possible to cause the magnetic abrasive grains 65 to collide with the external surface of the developing sleeve 132 more uniformly, and therefore to process the external surface of the developing sleeve 132 more uniformly.

Since the container 9 has the columnar shape, the container 9 does not block movements of the magnetic abrasive grains 65 in the circumferential direction when the rotating magnetic field acts on the magnetic abrasive grains 65. Accordingly, stable processing can be achieved.

The partitioning members 55 partition the space in the longitudinal direction inside the container 9. Thus, by limiting the movable areas (rotation/revolution areas) of the magnetic abrasive grains 65 with the partitioning members 55, more efficient processing can be carried out.

Moreover, the magnetic abrasive grains 65 can be prevented from moving beyond the partitioning member 55. This makes it possible to surely move the magnetic abrasive grains 65 and the rotating magnetic field relatively to each other, and therefore to surely demagnetize the magnetic abrasive grains 65.

The partitioning members 55 are composed of the non-magnetic material, and accordingly are not magnetized. For this reason, neither the partitioning members 55 disturb the movements of the magnetic abrasive grains 65, nor magnetized shavings and the like are attracted and adhere to the partitioning members 5. Accordingly, stable processing can be performed.

By providing the plurality of partitioning members 55, an area to be roughened at one time can be limited to a certain part of the external surface of the developing sleeve 132. Thus, the partitioning members 55 surely limit the movable areas (rotation/revolution areas) of the magnetic abrasive grains 65, and therefore more efficient processing can be carried out.

In addition, since the magnetic abrasive grains 65 can be prevented from moving beyond the partitioning member 55, the magnetic abrasive grains 65 can be surely demagnetized.

Employing the external wall of the single structure for the cylindrical member 50 of the container 9 can make short the distance between the electromagnetic coil 8 and the developing sleeve 132, and therefore the rotating magnetic field generated by the electromagnetic coil 8 can be more efficiently used for processing.

Use of the sealing plates 53 makes it possible to prevent the magnetic abrasive grains 65 from getting out of the container 9, and thereby to improve the workability and productivity at the time of processing. This effect can be further increased if continuous processing is performed. Thus, the surface processing apparatus 1 can manufacture (process) developing sleeves 132 as a mass production apparatus base on high-volume processing.

In addition, immediately after the surface roughening process on the process target object 2 is completed, the movable holding unit 6 can move the process target object 2 to the measurement place where the roughness of the surface is measured, while the hollow holding member 32 is holding the process target object 2. Thus, immediately after the surface roughening process on the process target object 2 is completed, the roughness of the surface of the process target object 2 can be measured. Accordingly, it is possible to shorten a time period between the surface roughening process and the roughness measurement. Thus, the productivity for the developing sleeves 132 can be increased as compared with a conventional case using a dedicated measurement apparatus.

The asperities on the external surface of the process target object 2 are measured by the reflection-type displacement gauge 80 while the drive motor 33 is rotating the process target object 2 about the axial center P with the process target object 2 kept held by the hollow holding member 32. In this way, a measurement result in a circumferential direction of the process target object 2 can be obtained. Thus, the measurement result with high reliability can be obtained.

A profile curve of the process target object 2 with high resolution and high accuracy can be obtained by measuring the asperities on the external surface of the process target object 2 with the reflection-type displacement gauge 80.

The controlling device 76 performs an FFT on the profile curve in the circumferential direction of the process target object 2 measured by the reflection-type displacement gauge 80, and judges whether or not the process target object 2 is a defective item, on the basis of the intensity of the predetermined wavelength component, in the obtained spectrum. In this way, a defective/non-defective judgment can be easily made by presetting the frequency component and its intensity used for judgment. Consequently, it is possible to easily manufacture developing sleeves 132 used for developing rollers 115 that can offer stable images with a pick-up amount of developer maintained stable over a long time.

In the foregoing image forming apparatus 101, the process cartridges 106Y, 106M, 106C and 106K each include the cartridge case 111, the charging roller 109, the photosensitive drum 108, the cleaning blade 112 and the development device 113. According to the present invention, however, the process cartridges 106Y, 106M, 106C and 106K may not necessarily include the cartridge case 111, the charging roller 109, the photosensitive drum 108 and the cleaning blade 112, as long as each of them include at least the development device 113. Moreover, in the aforementioned embodiment, the image forming apparatus 101 includes the process cartridges 106Y, 106M, 106C and 106K that are detachably attached to the apparatus main body 102. According to the present invention, nevertheless, the image forming apparatus 101 may not necessarily include the process cartridges 106Y, 106M, 106C and 106K as long as it includes at least the development device 113.

It is obvious that the outer diameter of the developing sleeve 132, the size of the magnetic abrasive grain 65 and the outer diameter of the cylindrical member 50 of the container 9, described in the above embodiment, can be changed as needed. Moreover, it is desirable to select a suitable shape for the shape of both ends of the developing sleeve 132 in consideration of the curvature radius of a chamfered portion, the size of the chamfered shape, the targeted roughness of the rough surface, the processing time (processing conditions), the number of reciprocating times of the electromagnetic coil 8, the durability of the magnetic abrasive grain 65 and the like. In addition, it is also desirable to determine a suitable amount for the amount of magnetic abrasive grains 65 accommodated in the container 9 in consideration of the targeted roughness of the rough surface, the processing time (processing conditions), the number of reciprocating times of the electromagnetic coil 8, the durability of the magnetic abrasive grain 65 and the like.

Subsequently, the inventors of the present invention grinded an aluminum piece to have the outer diameter of ø18 as a process target object 2 that is a developing sleeve 132 as the foregoing hollow body, and formed asperities on the circumferential surface by using the apparatus shown in FIGS. 8 and 9. The processing was carried out under the conditions that: magnetic abrasive grains 65 made of an SUS304 and each having a diameter ø0.8×5 mm were employed; the current value of the three-phase alternating-current source 48 was 24 A; a moving speed of the electromagnetic coil 8 was 100 mm/sec; and the number of reciprocating times of the electromagnetic coil 8 was three. At that time, the process target object 2 was set so as to be freely rotatable with a load placed thereon, and the free rotating speed was 3000 RPM. The ten point height of irregularities Rz of the developing sleeve 132 obtained as a result of this processing was 12 μm.

The developing sleeve 132 was measured by using an LT series laser displacement sensor of a laser focus type manufactured by Keyence Corporation as the reflection-type displacement gauge 80, and by taking 18000 data from the developing sleeve 132 at equal intervals while rotating the developing sleeve 132 for one rotation at a speed 12 sec per rotation. An FFT analysis was performed using 4096 data out of the 18000 data.

Since noise components contained in the data probably generate irregular peaks in a FFT result, 5-data moving averages were calculated to obtain the spectrum intensity with respect to the wavelength.

In addition, similar processing were performed on other process target objects 2 by adjusting the load placed thereon so that the process target objects 2 could rotate at 2500 RPM, 4000 RPM, 5000 RPM and 6000 RPM, respectively. Then, in the same manner as in the case of 3000 RPM, data were taken and an FFT analysis was performed for each of the process target objects 2. The ten point height of irregularities Rz of each developing sleeve 132 obtained as a result of this was also 12 μm.

The performance of each of the sleeves obtained by this processing and used in a development device was examined. The performance was evaluated by examining an initial pick-up amount, the initially-formed image, a change rate in the pick-up amount after running on 10000 sheets, and the image formed after running on 10000 sheets. The evaluation results are shown in Table 1 and FIG. 16. As examples of the present invention, Table 1 shows an example 1 that is a sleeve roughened by the aforementioned roughening process at 5000

RPM, an example 2 that is a sleeve roughened by the roughening process at 4000 RPM, an example 3 that is a sleeve roughened by the roughening process at 3000 RPM, and an example 4 that is a sleeve roughened by the roughening process at 2500 RPM. In addition, as comparative examples, Table 1 shows a comparative example 1 that is a hollow body of the same size roughened by the roughening process using sandblasting, a comparative example 2 that is a hollow body of the same size similarly roughened by the roughening process using bead blasting, a comparative example 3 that is a hollow body of the same size similarly roughened by the roughening process at 6000 RPM, as described above. FIG. 16 is a graph showing the comparative examples 1 to 4 and the examples 1 to 4. In this graph, the vertical axis is the change rate in the pick-up amount, and the horizontal axis is the peak intensity of a spectrum within a range of wavelengths not more than 1 mm.

more than 12 that is indicated as a point of intersection of the dotted lines and the axis of 10% of the change rate in the pick-up amount. In addition, when the change rate in the pick-up amount is not more than 6%, the change in the pick-up amount affects image quality only to an extremely small extent, and stable image quality can be obtained over time. From FIG. 16, it similarly is clear that the change rate is not more than 6%, when the peak intensity of FFT spectrum is not more than 10. In other words, it is evident that, in the example 1, the change rate in the pick-up amount affects image quality to a small extent, and that in each of the examples 2 to 4, the change rate in the pick-up amount affects image quality only to such a small extent that stable image quality can be obtained over time.

Accordingly, it is clear from Table 1 and FIG. 16 that a developing sleeve 132, like the examples 1 to 4, which is processed and evaluated by the surface processing apparatus

| | Sleeve Processing Method | Processing Condition | Initial Image | Image after 10k Run | Change Rate in Pick-up Amount | Peak Intensity of FFT Spectrum |
|---|---|---|---|---|---|---|
| Comparative Example 1 | Sandblast | — | G | P | 12.0% | 10.8 |
| Comparative Example 1 | Bead Blast | — | G | P | 16.0% | 18.5 |
| Comparative Example 1 | Surface Processing With Apparatus in FIG. 8 | Sleeve RPM: 6000 | G | P | 13.0% | 15.0 |
| Example 1 | Surface Processing With Apparatus in FIG. 8 | Sleeve RPM: 5000 | G | G | 9.5% | 11.6 |
| Example 2 | Surface Processing With Apparatus in FIG. 8 | Sleeve RPM: 4000 | E | G | 4.2% | 8.8 |
| Example 3 | Surface Processing With Apparatus in FIG. 8 | Sleeve RPM: 3000 | E | G | 1.4% | 7.2 |
| Example 4 | Surface Processing With Apparatus in FIG. 8 | Sleeve RPM: 2500 | E | G | 1.4% | 7.1 |

Evaluation scores in Table 1 include E indicating that a sleeve is so excellent as to be workable in practice, G indicating that a sleeve is good enough to be workable in practice, and P indicating that a sleeve is too poor to work in practice.

Moreover, a developer used for this examination contained carriers each having a diameter of 35 μm, and toner particles whose average grain size is from 3 μm to 7 μm inclusive. The average grain size of the carriers is from 20 μm to 50 μm inclusive.

According to Table 1, it became evident from Table 1 that the examples 1 to 4 were each evaluated as being good enough to be workable in practice even after running on 10000 sheets (10 k sheets), and that the comparative example 3 was evaluated as being too poor to work in practice. This result clearly shows that a sleeve that is good enough to be workable in practice can be obtained when having the change rate in the pick-up amount of not more than 10%.

Here, FIG. 16 shows a dotted line that connects points plotted as the examples 1 to 4 and the comparative example 3 whose surfaces were processed by using the apparatus shown in FIGS. 8 and 9. Here, consider a range of the peak intensity of FFT spectrum that corresponds to not more than 10% of the change rate in the pick-up amount with which a sleeve that is good enough to be workable in practice can be obtained, and that is within a range of wavelengths not more than 1 mm. As is clear from FIG. 16, the range of the peak intensity is not shown in FIGS. 8 and 9, is to be subjected only to a small change in the pick-up amount over time, and can offer stable image quality over time Moreover, the relationship between the change rate in the pick-up amount and the peak intensity of FFT spectrum became evident from FIG. 16. As a result, instead of the change rate in the pick-up amount that requires a long time to be measured, the peak intensity of FFT spectrum, which can be measured immediately after processing, can be used in order to judge whether or not a processed sleeve is defective. By employing the peak intensity, it is possible to surely obtain a developing sleeve 132 that is to be subjected only to a small change in the pick-up amount over time, and can offer stable image quality over time As has been described above, the following method is effective as a method of manufacturing a sleeve that can offer high image quality and maintain a pick-up amount stable over time. To be more precise, in this method, firstly, the external surface of a process target object 2 is roughened by using the magnetic abrasive grains 65 inside a generated rotating magnetic field in the roughening process. Thereafter, the reflection-type displacement gauge 80, which is a noncontact type, is fixed to the position for measurement, and then takes data about the asperities on the external surface of the process target object 2 while the process target object 2 is being rotated at a certain degree. After that, an FFT analysis is performed by using the data thus taken to figure out the spectrum intensity relative to wavelengths. Then, finally, only a process target object 2 whose peak intensity of the FFT spectrum is not more than a certain value is judged as a non-defective item.

According to the embodiment of the present invention, the large number of oval depressions are randomly provided on the external surface of the hollow body, and the peak intensity of the spectrum, resulting from the frequency analysis using a profile curve of the external surface, within the range of wavelengths not more than 1 mm is not more than 12. Accordingly, use of the developer holding member gives developer only small stress, and thereby suppresses deterioration of the developer. Consequently, the pick-up amount of the developer is kept stable over a long time, which allows the developer to form high quality images free from density unevenness over a long time.

According to the embodiment of the present invention, the large number of oval depressions are randomly provided on the external surface of the hollow body, and the peak intensity of the spectrum, resulting from the frequency analysis using a profile curve of the external surface, within the range of wavelengths not more than 1 mm is not more than 10. Accordingly, the stress imposed on the developer can be reduced more, and thereby the deterioration of the developer can be further suppressed. Consequently, the pick-up amount of the developer is kept stable over a long time, which allows the developer to form high quality images free from density unevenness over a long time.

According to the embodiment of the present invention, the large number of oval depressions are formed by random collisions of the line-shaped grains like tows with the external surface. In this way, the characteristic that the peak intensity of the spectrum, resulting from the frequency analysis, within the range of wavelengths not more than 1 mm is not more than 10 can be easily obtained.

According to the embodiment of the present invention, since the development device includes the developer holding member according to the embodiment of the present invention, the development device can form high quality images free from unevenness over a long time.

According to the embodiment of the present invention, the diameter of the magnetic particle is from 20 μm to 50 μm inclusive. Accordingly, use of the developer makes it possible to obtain stable images with excellent granularity images over time.

According to the embodiment of the present invention, the magnetic particle has the resin coating film with which a core member made of a magnetic material is coated. The used resin coating film contains the charging control agent and the resin ingredient obtained by making cross-links between the melamine resin and the thermoplastic resin such as acryl. This structure is more excellent in wearability of the surface of the magnetic particle, and thereby use of the developer makes it possible to obtain stable images with excellent granularity images over time.

According to the embodiment of the present invention, since the process cartridge includes the development device according to the embodiment of the present invention, it is possible to provide a process cartridge that is small and excellent in granularity, and that is capable of offering high quality images free from unevenness.

According to the embodiment of the present invention, since the image forming apparatus includes the process cartridge according to the embodiment of the present invention, it is possible to provide an image forming apparatus that is small and excellent in granularity, and that is capable of offering high quality images free from unevenness.

According to the embodiment of the present invention, the profile curve is measured in a circumferential direction while rotating the hollow body after roughening the hollow body, the frequency analysis on the profile curve thus measured is performed, and then a judgment is made as to whether the hollow body is a defective item, by comparing the result of the frequency analysis with a predetermined judgment standard. Accordingly, a defective/non-defective judgment can be made easily by presetting a judgment standard. As a result, it is possible to easily manufacture a developer holding member used for a developing roller that can offer stable images with a pick-up amount of developer maintained stable over a long time.

It should be noted that the present invention is not limited to the foregoing embodiments. In other words, the present invention can be modified and embodied in various manners without departing from the essence of the present invention.

What is claimed is:

1. A method of manufacturing a hollow body having an external surface randomly provided with a large number of depressions, comprising the steps of:

providing the large number of depressions on the external surface of the hollow body;

obtaining a profile curve of the external surface in a circumferential direction while rotating the hollow body;

performing a frequency analysis on the obtained profile curve; and judging a quality of the hollow body by comparing a result of the frequency analysis with a predetermined judgment standard, wherein the hollow body includes thereinside a magnetic field generating device, and attracts a developer to the external surface thereof with magnetic force of the magnetic field generating device, and a peak intensity of a spectrum within a range of wavelengths not more than 1 mm, which is figured out by performing the frequency analysis using the profile curve in the circumferential direction of the external surface, is closely below a wavelength of 0.3 mm and is not more than 12 dB.

* * * * *